US010905297B2

(12) United States Patent
O'Brien et al.

(10) Patent No.: US 10,905,297 B2
(45) Date of Patent: Feb. 2, 2021

(54) CLEANING HEAD INCLUDING CLEANING ROLLERS FOR CLEANING ROBOTS

(71) Applicant: iRobot Corporation, Bedford, MA (US)

(72) Inventors: John P. O'Brien, Newton, MA (US); Eric Burbank, Bedford, MA (US)

(73) Assignee: iRobot Corporation, Bedford, MA (US)

( * ) Notice: Subject to any disclaimer, the term of this patent is extended or adjusted under 35 U.S.C. 154(b) by 333 days.

(21) Appl. No.: 16/185,472

(22) Filed: Nov. 9, 2018

(65) Prior Publication Data

US 2019/0208971 A1 Jul. 11, 2019

Related U.S. Application Data

(60) Provisional application No. 62/614,328, filed on Jan. 5, 2018.

(51) Int. Cl.

| | |
|---|---|
| ***A47L 9/04*** | (2006.01) |
| ***A47L 11/40*** | (2006.01) |
| ***A47L 11/282*** | (2006.01) |

(52) U.S. Cl.

CPC ..... *A47L 9/0477* (2013.01); *A47L 11/282* (2013.01); *A47L 11/4041* (2013.01); *A47L 2201/00* (2013.01)

(58) Field of Classification Search

CPC .. A47L 9/0477; A47L 11/282; A47L 11/4041; A47L 2201/00

See application file for complete search history.

(56) References Cited

U.S. PATENT DOCUMENTS

| | | | |
|---|---|---|---|
| D125,786 | S | 3/1941 | Schaad |
| D222,702 | S | 12/1971 | Schaefer et al. |
| 3,828,387 | A | 8/1974 | Liebscber |
| 4,042,997 | A | 8/1977 | McDowell |
| 4,307,479 | A | 12/1981 | Mertes et al. |
| 4,777,691 | A | 10/1988 | Richmond et al. |
| 4,832,098 | A | 5/1989 | Palinkas et al. |

(Continued)

FOREIGN PATENT DOCUMENTS

| | | |
|---|---|---|
| EP | 2713844 | 4/2014 |

OTHER PUBLICATIONS

European Search Report in European Patent Application No. 18207133.2, dated May 20, 2019 5 pages.

*Primary Examiner* — Dung Van Nguyen
(74) *Attorney, Agent, or Firm* — Fish & Richardson P.C.

(57) ABSTRACT

A robot that includes a cleaning head including a first cleaning roller comprising a first sheath comprising a first shell and a first plurality of vanes extending along the first shell and extending radially outward from the first shell, the first shell tapering from end portions of the first sheath toward a center of the first cleaning roller, and the first plurality of vanes having a uniform height relative to a first axis of rotation of the first cleaning roller; and a second cleaning roller comprising a second sheath comprising a second shell and a second plurality of vanes extending along the second shell and extending radially outward from the second shell, the second shell being cylindrical along an entire length of the second cleaning roller, and the second plurality of vanes having a uniform height relative to a second axis of rotation of the second cleaning roller.

20 Claims, 22 Drawing Sheets

(56) References Cited

U.S. PATENT DOCUMENTS

| | | | |
|---|---|---|---|
| 4,912,805 | A | 4/1990 | Krasznai |
| 5,251,355 | A | 10/1993 | Drumm |
| 5,452,490 | A | 9/1995 | Brundula et al. |
| 5,495,634 | A | 3/1996 | Brundula et al. |
| 6,108,853 | A | 8/2000 | Dittus |
| D431,698 | S | 10/2000 | Hoshide et al. |
| D471,332 | S | 3/2003 | Haegermarck et al. |
| 6,539,575 | B1 | 4/2003 | Cohen |
| 6,564,417 | B2 | 5/2003 | Porat |
| 6,574,823 | B1 | 6/2003 | Stegens |
| D478,698 | S | 8/2003 | Mertes et al. |
| 6,615,885 | B1 | 9/2003 | Ohm |
| D518,258 | S | 3/2006 | Hamm et al. |
| 7,553,123 | B2 | 6/2009 | Casaro |
| D647,265 | S | 10/2011 | Follows et al. |
| 8,104,524 | B2 | 1/2012 | Manesh et al. |
| 8,239,992 | B2 | 8/2012 | Schnittman et al. |
| D669,010 | S | 10/2012 | Nakano |
| 8,387,193 | B2 | 3/2013 | Ziegler et al. |
| D680,287 | S | 4/2013 | Morgan et al. |
| D680,289 | S | 4/2013 | Gray et al. |
| D681,291 | S | 4/2013 | Morgan et al. |
| D699,010 | S | 2/2014 | Gilbert et al. |
| 8,661,605 | B2 | 3/2014 | Svendsen et al. |
| D716,510 | S | 10/2014 | Gilbert et al. |
| 8,881,339 | B2 | 11/2014 | Gilbert et al. |
| 8,910,342 | B2 | 12/2014 | Gilbert et al. |
| 8,955,192 | B2 | 2/2015 | Gilbert et al. |
| 9,220,386 | B2 | 12/2015 | Gilbert et al. |
| 9,320,400 | B2 | 4/2016 | Gilbert et al. |
| 9,326,654 | B2 | 5/2016 | Doughty |
| 9,675,224 | B2 | 6/2017 | Gilbert et al. |
| 2004/0074038 | A1 | 4/2004 | Im |
| 2006/0236500 | A1 | 2/2006 | Dominique et al. |
| 2006/0053584 | A1 | 3/2006 | Dever |
| 2008/0052846 | A1* | 3/2008 | Kapoor ..... A47L 9/0477 15/52.1 |
| 2008/0244852 | A1 | 10/2008 | Alton |
| 2008/0276407 | A1 | 11/2008 | Schnittman et al. |
| 2008/0307597 | A1 | 12/2008 | Davidshofer et al. |
| 2011/0162160 | A1 | 7/2011 | Whittaker |
| 2012/0079670 | A1 | 4/2012 | Yoon et al. |
| 2012/0090126 | A1 | 4/2012 | Kim et al. |
| 2012/0199006 | A1 | 8/2012 | Swett |
| 2013/0205520 | A1 | 8/2013 | Kapoor et al. |
| 2014/0259475 | A1* | 9/2014 | Doughty ..... A47L 9/009 15/52.1 |
| 2016/0166127 | A1* | 6/2016 | Lewis ..... A47L 9/0477 15/49.1 |
| 2016/0213217 | A1 | 7/2016 | Doughty et al. |
| 2017/0238780 | A1 | 8/2017 | Gilbert et al. |
| 2018/0168417 | A1* | 6/2018 | Goddard ..... A47L 11/24 |
| 2018/0177367 | A1* | 6/2018 | Amaral ..... A47L 9/0477 |

* cited by examiner

CLEANING HEAD INCLUDING CLEANING ROLLERS FOR CLEANING ROBOTS

CROSS-REFERENCE TO RELATED APPLICATIONS

This application claims priority to U.S. application Ser. No. 62/614,328, filed on Jan. 5, 2018.

TECHNICAL FIELD

This specification relates to a cleaning head that includes cleaning rollers, in particular, for cleaning robots.

BACKGROUND

An autonomous cleaning robot can navigate across a floor surface and avoid obstacles while vacuuming the floor surface to ingest debris from the floor surface. The cleaning robot can include rollers to pick up the debris from the floor surface. As the cleaning robot moves across the floor surface, the robot can rotate the rollers, which guide the debris toward a vacuum airflow generated by the cleaning robot. In this regard, the rollers and the vacuum airflow can cooperate to allow the robot to ingest debris. During its rotation, the roller can engage debris that includes hair and other filaments. The filament debris can become wrapped around the rollers.

SUMMARY

Advantages of the foregoing may include, but are not limited to, those described below and herein elsewhere. The cleaning head includes multiple rollers that are different from one another, which improves pickup of debris from a floor surface and improves the durability of the cleaning head.

A first cleaning roller of the cleaning head includes a non-solid core inside a roller sheath that extends across the length of the second cleaning roller. With the roller sheath being interlocked with the non-solid core at a central portion of the core, torque applied to the core can be easily transferred to the sheath such that the sheath can rotate and draw debris into the robot in response to rotation of the core. This interlocking mechanism between the sheath and the core can use less material than rollers that have sheaths and cores interlocked across a large portion of the overall length of the roller, e.g., 50% or more of the overall length of the roller. The second cleaning roller includes a conical sheath.

A second cleaning roller includes a rugged and durable design. The first cleaning roller contacts the floor surface with greater friction than the second roller to improve the cleaning capability of the cleaning head. Torque for the first roller can be more easily transferred from a drive shaft to an outer surface of the cleaning roller along an entire length of the cleaning roller. The improved torque transfer enables the outer surface of the cleaning roller to more easily move the debris upon engaging the debris and to more firmly engage the floor surface than other rollers. The first cleaning roller includes a solid core which can enable the first cleaning roller to more firmly engage the floor surface than other cleaning rollers. The solid core configuration of the first cleaning roller enables the cleaning roller to prevent debris from passing under the cleaning head without being removed from the cleaning surface. The first cleaning roller includes a sheath that has a cylindrical shape to facilitate debris removal.

Furthermore, circular members that radially support the sheath can have a relatively small thickness compared to an overall length of the second cleaning roller. The circular members can thus provide radial support to the sheath without contributing a significant amount of mass to the overall mass of the second cleaning roller. Between locations at which the sheath is radially supported, the resilience of the sheath enables the sheath to deform radially inward in response to contact with debris and other objects and then resiliently return to an undeformed state when the debris or other objects are no longer contacting the sheath. As a result, the core does not need to support the sheath across an entire length of the sheath, thereby reducing the overall amount of material used for supporting the sheath. The decreased overall material used in the roller, e.g., through use of the interlocking mechanism and the circular members, can decrease vibrations induced by rotation of the roller and can decrease the risk of lateral deflection of the roller induced by centripetal forces on the roller. This can improve the stability of the roller during rotation of the roller while also decreasing the amount of noise generated upon impact of the roller with objects, e.g., debris or the floor surface. Furthermore, positioning the second cleaning roller forward of the second cleaning roller enables the cleaning head to ingest more debris. The second cleaning roller, positioned forward of the first cleaning roller, pulls in debris (deforming if necessary), and the first cleaning roller, positioned rearward of the second cleaning roller, firmly engages the cleaning surface and reduces amounts of debris that pass under the cleaning head without being removed from the cleaning surface.

The cleaning rollers can have an increased length without reducing the ability of the cleaning roller to pick up debris from the floor surface. In particular, the cleaning roller, when longer, can require a greater amount of drive torque. However, because of the improved torque transfer of the cleaning roller, a smaller amount of torque can be used to drive the cleaning roller to achieve debris pickup capability similar to the debris pickup capability of other cleaning rollers. If the cleaning roller is mounted to a cleaning robot, the cleaning roller can have a length that extends closer to lateral sides of the cleaning robot so that the cleaning roller can reach debris over a larger range.

In other examples, the cleaning roller can be configured to collect filament debris in a manner that does not impede the cleaning performance of the cleaning roller. The filament debris, when collected, can be easily removable. In particular, as the cleaning roller engages with filament debris from a floor surface, the cleaning roller can cause the filament debris to be guided toward outer ends of the cleaning roller where collection wells for filament debris are located. The collection wells can be easily accessible to the user when the rollers are dismounted from the robot so that the user can easily dispose of the filament debris. In addition to preventing damage to the cleaning roller, the improved collection of filament debris can reduce the likelihood that filament debris will impede the debris pickup ability of the cleaning roller, e.g., by wrapping around the outer surface of the cleaning roller.

The roller can further include features that make the roller more easily manufactured and assembled. For example, locking features such as the locking members provide coupling mechanisms between the components of the roller, e.g., the sheath, the core, and the circular members, without fasteners or adhesives.

In further examples, the cleaning rollers can cooperate with each other to define a separation therebetween that improves characteristics of airflow generated by a vacuum assembly. The separation, by being larger toward a center of the cleaning rollers, can concentrate the airflow toward the center of the cleaning rollers. While filament debris can tend to collect toward the ends of the cleaning rollers, other debris can be more easily ingested through the center of the cleaning rollers where the airflow rate is highest.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
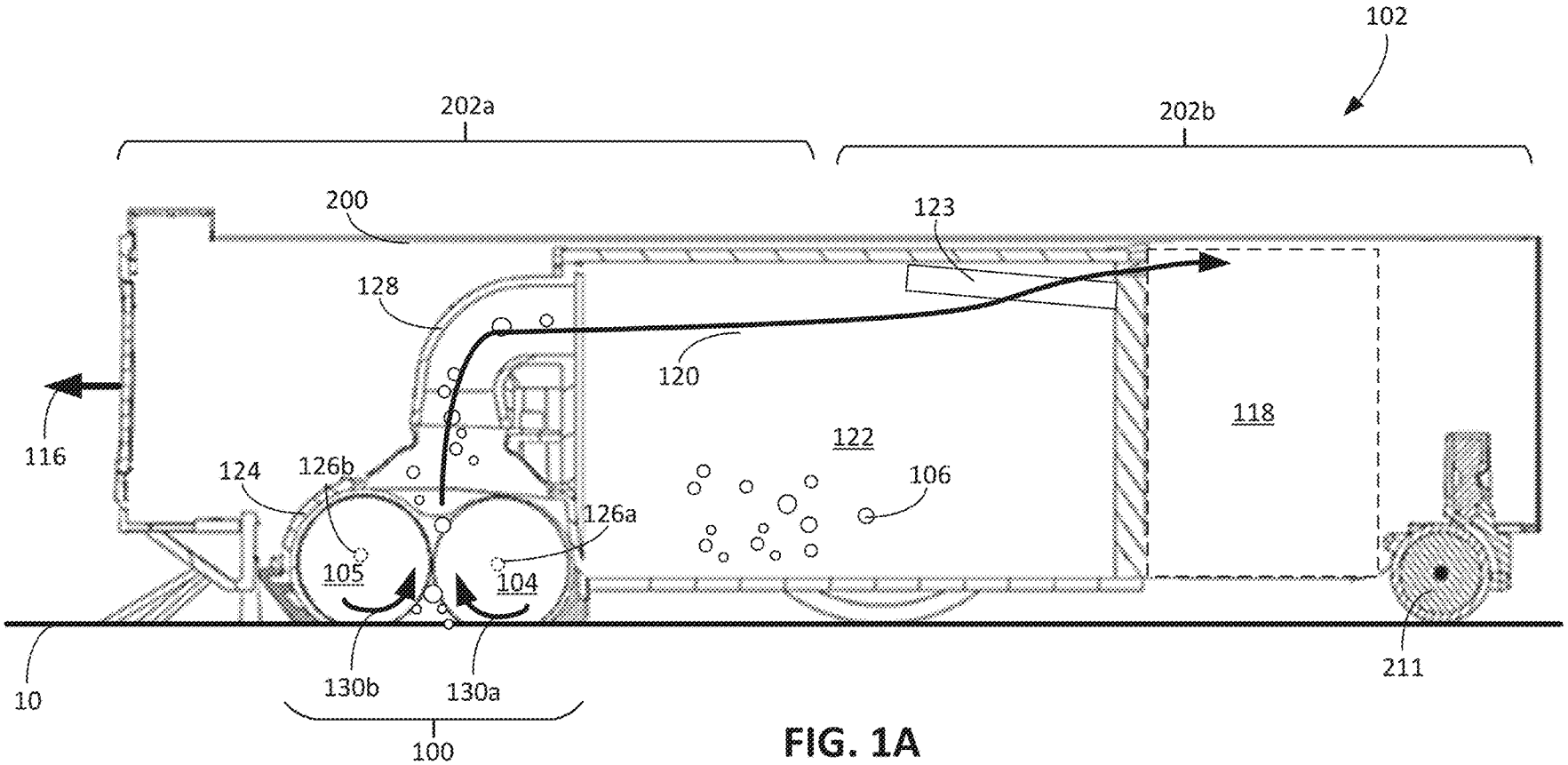
FIG. 1A is a cross-sectional side view of a cleaning robot and the cleaning head of FIG. 1B during the cleaning operation.
Figure 1B:
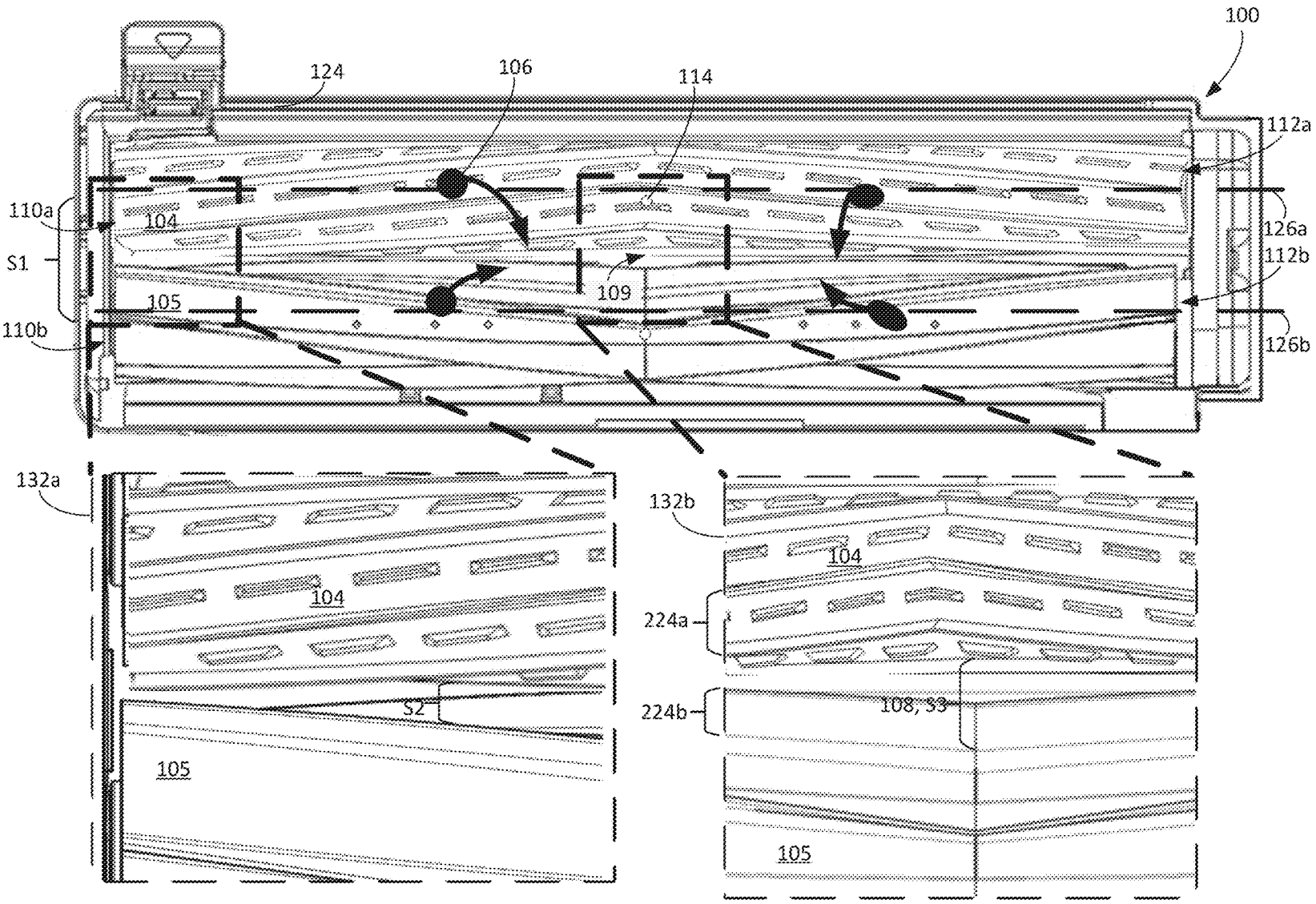
FIG. 1B is a bottom view of a cleaning head during a cleaning operation of a cleaning robot.

Referring to FIGS. 1A and 1B, a cleaning head 100 for a cleaning robot 102 includes cleaning rollers 104, 105 that are positioned to engage debris 106 on a floor surface 10. FIG. 1B depicts the cleaning head 100 during a cleaning operation, with the cleaning head 100 isolated from the cleaning robot 102 to which the cleaning head 100 is mounted. The cleaning rollers 104, 105 are different from one another, as described in further detail throughout this specification. The rear cleaning roller 104 is positioned rearward in the cleaning head 100 of the forward cleaning roller 105. The rear cleaning roller 104 includes a solid core (e.g., described in relation to FIGS. 3B-3E and 4A-4D). The forward cleaning roller 105 includes a non-solid core (e.g., described in relation to FIGS. 3F-3H and 4E-4F). Though the cleaning rollers 104, 105 are referred to as the "forward cleaning roller 105" and the "rear cleaning roller 104", respectively, the positions of the cleaning rollers 104, 105 can be switched such that the rear cleaning roller 104 is positioned forward of the forward cleaning roller 105 in the cleaning head 100.

The cleaning robot 102 moves about the floor surface 10 while ingesting the debris 106 from the floor surface 10. FIG. 1A depicts the cleaning robot 102, with the cleaning head 100 mounted to the cleaning robot 102, as the cleaning robot 102 traverses the floor surface 10 and rotates the cleaning rollers 104, 105 to ingest the debris 106 from the floor surface 10 during the cleaning operation. During the cleaning operation, the cleaning rollers 104, 105 are rotatable to lift the debris 106 from the floor surface 10 into the cleaning robot 102. Outer surfaces of the cleaning rollers 104, 105 engage the debris 106 and agitate the debris 106. The rotation of the cleaning rollers 104, 105 facilitates movement of the debris 106 toward an interior of the cleaning robot 102. For example, the rear cleaning roller 104 engages the floor surface 10 more firmly during cleaning than the forward cleaning roller 105. The forward cleaning roller 105 engages the floor surface more lightly than rear cleaning roller 104. The rear cleaning roller 104 is more durable than the forward cleaning roller 105 and prevents debris from passing under the cleaning head 100 without being extracted from the cleaning surface 10. The forward cleaning roller 105 lightly agitates the debris so that the cleaning head 100 can extract the debris from the cleaning surface.

In some implementations, as described herein, the cleaning rollers 104, 105 are elastomeric rollers featuring a pattern of chevron-shaped vanes 224*a*, 224*b* (shown in FIG. 1B) distributed along an exterior surface of the cleaning rollers 104, 105. The vanes 224*a*, 224*b* of at least one of the cleaning rollers 104, 105, e.g., the rear cleaning roller 104, make contact with the floor surface 10 along the length of the cleaning rollers 104, 105 and experience a consistently applied friction force during rotation that is not present with brushes having pliable bristles. Furthermore, like cleaning rollers having distinct bristles extending radially from a shaft, the cleaning rollers 104, 105 have vanes 224*a*, 224*b* that extend radially outward. The vanes 224*a*, 224*b*, however, also extend continuously along the outer surface of the cleaning rollers 104, 105 in longitudinal directions. The vanes 224*a*, 224*b* also extend along circumferential directions along the outer surface of the cleaning rollers 104, 105, thereby defining V-shaped paths along the outer surface of the cleaning rollers 104, 105 as described herein. Other suitable configurations, however, are also contemplated. For example, in some implementations, at least one of the rear and front cleaning rollers 104, 105 may include bristles and/or elongated pliable flaps for agitating the floor surface in addition or as an alternative to the vanes 224*a*, 224*b*. In some implementations, the cleaning rollers 104, 105 have different configurations of the outer surfaces (e.g., as described in FIGS. 5E and 7A-7C, below). For example, the rear cleaning roller 104 includes fewer vanes than forward cleaning roller 105.

As shown in FIG. 1B, a separation 108 and an air gap 109 are defined between the rear cleaning roller 104 and the forward cleaning roller 105. The separation 108 and the air gap 109 both extend from a first outer end portion 110*a* of the rear cleaning roller 104 to a second outer end portion 112*a* of the rear cleaning roller 104. As described herein, the separation 108 corresponds a distance between the cleaning rollers 104, 105 absent the vanes on the cleaning rollers 104, 105, while the air gap 109 corresponds to the distance between the cleaning rollers 104, 105 including the vanes on the cleaning rollers 104, 105. The air gap 109 is sized to accommodate debris 106 moved by the cleaning rollers 104, 105 as the cleaning rollers 104, 105 rotate and to enable airflow to be drawn into the cleaning robot 102 and change in width as the cleaning rollers 104, 105 rotate. While the air gap 109 can vary in width during rotation of the cleaning rollers 104, 105, the separation 108 has a constant width during rotation of the cleaning rollers 104, 105. The separation 108 facilitates movement of the debris 106 caused by the cleaning rollers 104, 105 upward toward the interior of the robot 102 so that the debris can be ingested by the robot 102. As described herein, the separation 108 increases in size toward a center 114 of a length L1 of the rear cleaning roller 104, e.g., a center of the cleaning roller 114*a* along a longitudinal axis 126*a* of the cleaning roller 114*a*. The separation 108 decreases in width toward the end portions 110*a*, 112*a* of the rear cleaning roller 104. Such a configuration of the separation 108 can improve debris pickup capabilities of the cleaning rollers 104, 105 while reducing likelihood that filament debris picked up by the cleaning rollers 104, 105 impedes operations of the cleaning rollers 104, 105.

Example Cleaning Robots

Figure 2A:
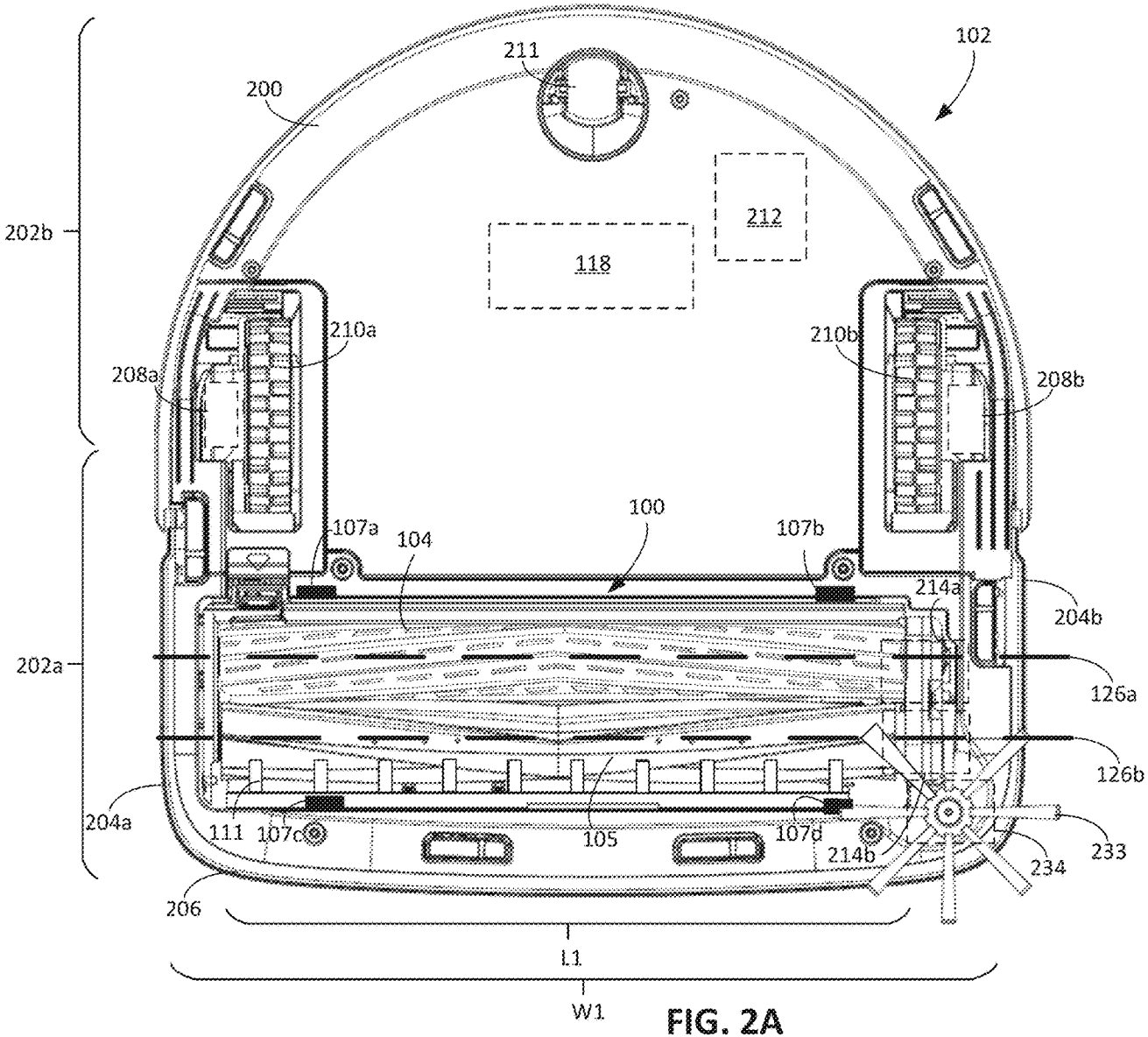
FIG. 2A is a bottom view of the cleaning robot of FIG. 1A.

The cleaning robot 102 is an autonomous cleaning robot that autonomously traverses the floor surface 10 while ingesting the debris 106 from different parts of the floor surface 10. In the example depicted in FIGS. 1A and 2A, the robot 102 includes a body 200 movable across the floor surface 10. The body 200 includes, in some cases, multiple connected structures to which movable components of the cleaning robot 102 are mounted. The connected structures include, for example, an outer housing to cover internal components of the cleaning robot 102, a chassis to which drive wheels 210*a*, 210*b* and the cleaning rollers 104, 105 are mounted, a bumper mounted to the outer housing, etc. As shown in FIG. 2A, in some implementations, the body 200 includes a front portion 202*a* that has a substantially rectangular shape and a rear portion 202*b* that has a substantially semicircular shape. The front portion 202*a* is, for example, a front one-third to front one-half of the cleaning robot 102, and the rear portion 202*b* is a rear one-half to two-thirds of the cleaning robot 102. The front portion 202*a* includes, for example, two lateral sides 204*a*, 204*b* that are substantially perpendicular to a front side 206 of the front portion 202*a*.

As shown in FIG. 2A, the robot 102 includes a drive system including actuators 208*a*, 208*b*, e.g., motors, operable with drive wheels 210*a*, 210*b*. The actuators 208*a*, 208*b* are mounted in the body 200 and are operably connected to the drive wheels 210*a*, 210*b*, which are rotatably mounted to the body 200. The drive wheels 210*a*, 210*b* support the body 200 above the floor surface 10. The actuators 208*a*, 208*b*, when driven, rotate the drive wheels 210*a*, 210*b* to enable the robot 102 to autonomously move across the floor surface 10.

The robot 102 includes a controller 212 that operates the actuators 208*a*, 208*b* to autonomously navigate the robot 102 about the floor surface 10 during a cleaning operation. The actuators 208*a*, 208*b* are operable to drive the robot 102 in a forward drive direction 116 (shown in FIG. 1A) and to turn the robot 102. In some implementations, the robot 102 includes a caster wheel 211 that supports the body 200 above the floor surface 10. The caster wheel 211, for example, supports the rear portion 202*b* of the body 200 above the floor surface 10, and the drive wheels 210*a*, 210*b* support the front portion 202*a* of the body 200 above the floor surface 10.

As shown in FIGS. 1A and 2A, a vacuum assembly 118 is carried within the body 200 of the robot 102, e.g., in the rear portion 202*b* of the body 200. The controller 212 operates the vacuum assembly 118 to generate an airflow 120 that flows through the air gap 109 near the cleaning rollers 104, 105, through the body 200, and out of the body 200. The vacuum assembly 118 includes, for example, an impeller that generates the airflow 120 when rotated. The airflow 120 and the cleaning rollers 104, 105, when rotated, cooperate to ingest debris 106 into the robot 102. A cleaning bin 122 mounted in the body 200 contains the debris 106 ingested by the robot 102, and a filter 123 in the body 200 separates the debris 106 from the airflow 120 before the airflow 120 enters the vacuum assembly 118 and is exhausted out of the body 200. In this regard, the debris 106 is captured in both the cleaning bin 122 and the filter 123 before the airflow 120 is exhausted from the body 200.

As shown in FIGS. 1A and 2A, the cleaning head 100 and the cleaning rollers 104, 105 are positioned in the front portion 202*a* of the body 200 between the lateral sides 204*a*, 204*b*. The cleaning rollers 104, 105 are operably connected to actuators 214*a*, 214*b*, e.g., motors. The cleaning head 100 and the cleaning rollers 104, 105 are positioned forward of the cleaning bin 122, which is positioned forward of the vacuum assembly 118. In the example of the robot 102 described with respect to FIGS. 2A, 2B, the substantially rectangular shape of the front portion 202*a* of the body 200 enables the cleaning rollers 104, 105 to be longer than rollers for cleaning robots with, for example, a circularly shaped body.

The cleaning rollers 104, 105 are mounted to a housing 124 of the cleaning head 100 and mounted, e.g., indirectly or directly, to the body 200 of the robot 102. In particular, the cleaning rollers 104, 105 are mounted to an underside of the front portion 202*a* of the body 200 so that the cleaning rollers 104, 105 engage debris 106 on the floor surface 10 during the cleaning operation when the underside faces the floor surface 10.

In some implementations, the housing 124 of the cleaning head 100 is mounted to the body 200 of the robot 102. In this regard, the cleaning rollers 104, 105 are also mounted to the body 200 of the robot 102, e.g., indirectly mounted to the body 200 through the housing 124. Alternatively or additionally, the cleaning head 100 is a removable assembly of the robot 102 in which the housing 124 with the cleaning rollers 104, 105 mounted therein is removably mounted to the body 200 of the robot 102. The housing 124 and the cleaning rollers 104, 105 are removable from the body 200 as a unit so that the cleaning head 100 is easily interchangeable with a replacement cleaning head.

The cleaning head 100 is moveable with respect to the body 200 of the robot 102. The cleaning head 100 moves to conform to undulations of the cleaning surface 10. One or more dampeners 107*a*, 107*b*, 107*c*, 107*d* are placed between the housing 124 of the cleaning head 100 and the body 200 of the robot 102. The dampeners 107*a-d* reduce noise that can occur when the cleaning head 100 moves with respect to the robot body 200. In some implementations, four dampeners 107*a-d* are distributed near corners of the cleaning head. However, the cleaning head 100 can include more than or fewer than four dampeners 107*a-d*. In some implementations, the dampeners 107*a-d* are affixed to the cleaning head 100. In some implementations, the dampeners 107*a-d* are affixed to the robot body 200. The dampeners 107*a-d* can be positioned at other locations between the robot body 200 and the cleaning head 100. The placement of the dampeners 107*a-d* does not restrict the movement of the cleaning head 100 with respect to the body 200, but rather allows the cleaning head to freely move as needed to follow undulations of the cleaning surface 10. The dampeners 107*a-d* include a soft, conformable material. For example, the dampeners 107*a-d* include felt pads.

In some implementations, rather than being removably mounted to the body 200, the housing 124 of the cleaning head 100 is not a component separate from the body 200, but rather, corresponds to an integral portion of the body 200 of the robot 102. The cleaning rollers 104, 105 are mounted to the body 200 of the robot 102, e.g., directly mounted to the integral portion of the body 200. The cleaning rollers 104, 105 are each independently removable from the housing 124 of the cleaning head 100 and/or from the body 200 of the robot 102 so that the cleaning rollers 104, 105 can be easily cleaned or be replaced with replacement rollers. As described herein, the cleaning rollers 104, 105 can include collection wells for filament debris that can be easily accessed and cleaned by a user when the cleaning rollers 104, 105 are dismounted from the housing 124.

The cleaning head 100 includes raking prows 111. The raking prows 111 are affixed to the housing 124 of the cleaning head 100. The raking prows 111 are configured to contact the cleaning surface 10 when the robot 102 is cleaning. The raking prows 111 are spaced to prevent large debris that cannot be ingested by the cleaning head 100 from passing beneath the cleaning head. The raking prows 111 can be curved over the rear cleaning roller 104. The curvature of the raking prows 111 enables the raking prows to enable the robot 100 to more easily traverse uneven surfaces. For example, the raking prows 111 enable the robot 102 to more easily climb onto a rug from another cleaning surface. The raking prows 111 prevent the cleaning head 100 from becoming stuck, ensnared, snagged, etc. on the cleaning surface 10, such as when the cleaning surface is uneven or has loose fibers.

The cleaning rollers 104, 105 are rotatable relative to the housing 124 of the cleaning head 100 and relative to the body 200 of the robot 102. As shown in FIGS. 1A and 2A, the cleaning rollers 104, 105 are rotatable about longitudinal axes 126*a*, 126*b* parallel to the floor surface 10. The axes 126*a*, 126*b* are parallel to one another and correspond to longitudinal axes of the cleaning rollers 104, 105, respectively. In some cases, the axes 126*a*, 126*b* are perpendicular to the forward drive direction 116 of the robot 102. The center 114 of the rear cleaning roller 104 is positioned along the longitudinal axis 126*a* and corresponds to a midpoint of the length L1 of the rear cleaning roller 104. The center 114, in this regard, is positioned along the axis of rotation of the rear cleaning roller 104.

Figure 2B:
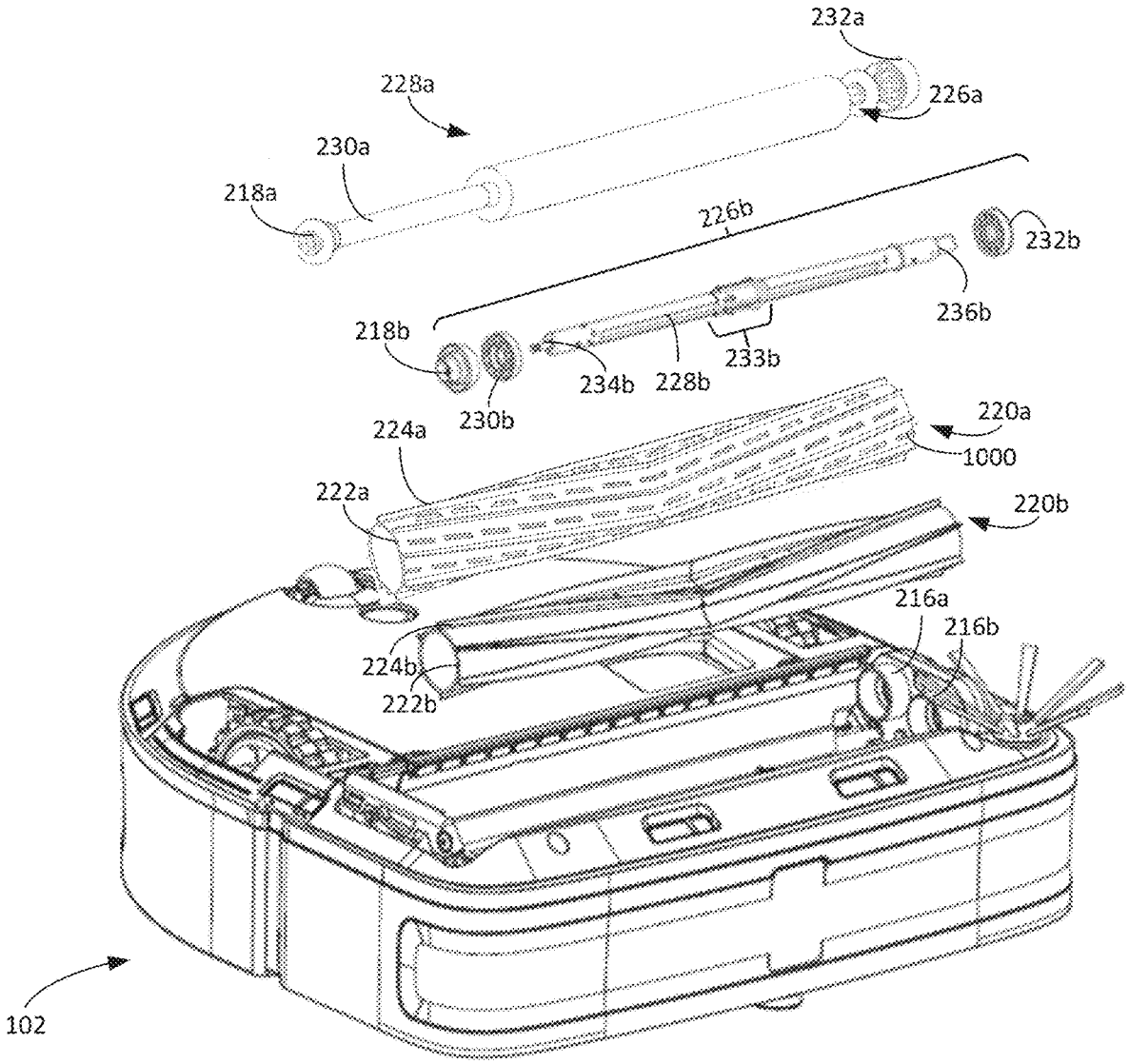
FIG. 2B is a side perspective exploded view of the cleaning robot of FIG. 2A.

In some implementations, referring to the exploded view of the cleaning head 100 shown in FIG. 2B. The rear cleaning roller 104 includes a sheath 220*a* including a shell 222*a* and vanes 224*a*. The rear cleaning roller 104 also includes a support structure 226*a* and a shaft 228*a*. The sheath 220*a* is, in some cases, a single molded piece formed from an elastomeric material. In this regard, the shell 222*a* and its corresponding vanes 224*a* are part of the single molded piece. The sheath 220*a* extends inward from its outer surface toward the shaft 228*a*, 228*b* such that the amount of material of the sheath 220*a* inhibits the sheath 220*a* from deflecting in response to contact with objects, e.g., the floor surface 10. The high surface friction of the sheath 220*a* enables the sheath 220*a* to engage the debris 106 and guide the debris 106 toward the interior of the cleaning robot 102, e.g., toward an air conduit 128 within the cleaning robot 102.

The shafts 228*a* and, in some cases, the support structure 226*a* are operably connected to the actuators 214*a* (shown schematically in FIG. 2A) when the rollers 104 are mounted to the body 200 of the robot 102. When the rear cleaning roller 104 is mounted to the body 200, mounting device 216*a* on the second end portion 232*a* of the shaft 228*a* couples the shaft 228*a* to the actuator 214*a*. The first end portion 230*a* of the shaft 228*a* is rotatably mounted to mounting device 218*a*, on the housing 124 of the cleaning head 100 or the body 200 of the robot 102. The mounting device 218*a* is fixed relative to the housing 124 or the body 200. In some cases, as described herein, portions of the support structure 226*a* cooperate with the shaft 228*a* to rotationally couple the rear cleaning roller 104 to the actuator 214*a* and to rotatably mount the rear cleaning roller 104 to the mounting device 218*a*.

For the forward cleaning roller 105, the shell 222*b* and its corresponding vanes 224*b* are part of the single molded piece. The shell 222*b* is radially supported by the support structure 226*b* at multiple discrete locations along the length of the forward cleaning roller 105 and is unsupported between the multiple discrete locations. For example, as described herein, the shell 222*b* is supported at a central portion 233*b* of the core 228*b* and by the first support member 230*b* and the second support member 232*b*. The first support member 230*b* and the second support member 232*b* are members having circular outer perimeters that contact encircling segments of an inner surface of the sheath 220*b*. The support members 230*b*, 232*b* thereby radially or transversally support the sheath 220*b*, e.g., inhibit deflection of the sheath 220*b* toward the longitudinal axis 126*b* (shown in FIG. 1B) in response to forces transverse to the longitudinal axis 126*b*. Where supported by the support members 230*b*, 232*b* or the central portion 233*b* of the core 228*b*, the sheath 220*b* is inhibited from deflecting radially inward, e.g., in response to contact with objects such as the floor surface 10 or debris collected from the floor surface 10. Furthermore, the support members 230*b*, 232*b* and the central portion 233*b* of the core 228*b* maintain outer circular shapes of the shell 222*b*.

Between the support member 232*b* and the central portion 233*b* of the core 228*b*, the sheath 220*b* is unsupported. For example, the support structure 226*b* does not contact the sheath 220*b* between the support members 230*b*, 232*b* and the central portion 233*b* of the core 228*b*. As described herein, the air gaps 242*b*, 244*b* span these unsupported portions and provide space for the sheath 220*b* to deflect radially inwardly, e.g., to deflect toward the longitudinal axis 126*b*.

The forward cleaning roller 105 further includes rod member 234*b* rotatably coupled to mounting device 218*b* and rotationally coupled to the support structure 226*b*. The mounting device 218*b* is mounted to the robot body 200, the cleaning head housing 124, or both so that the mounting device 218*b* is rotationally fixed to the robot body 200, the cleaning head housing 124, or both. In this regard, the rod member 234*b* and the core 228*b* rotate relative to the mounting device 218*b* as the forward cleaning roller 105 is driven to rotate.

The rod member 234*b* is an insert-molded component separate from the support structure 226*b*. For example, the rod member 234*b* is formed from metal and is rotatably coupled to the mounting device 218*b*, which in turn is rotationally fixed to the body 200 of the robot 102 and the housing 124 of the cleaning head 100. Alternatively, the rod member 234*b* is integrally formed with the support structure 226*b*.

The forward cleaning roller 105 further includes elongate portion 236*b* operably connected to an actuator 214*b* (shown schematically in FIG. 2A) of the robot 102 when the forward cleaning roller 105 is mounted to the body 200 of the robot 102 or the housing 124 of the cleaning head 100. The elongate portion 236*b* is rotationally fixed to engagement portions (not shown) of the actuation system of the robot 102, thereby rotationally coupling the forward cleaning roller 105 to the actuator 214. The elongate portion 236*b* also rotatably mounts the forward cleaning roller 105 to the body of the robot 102 and the housing 124 of the cleaning head 100 such that the forward cleaning roller 105 rotates relative to the body 200 and the housing 124 during the cleaning operation.

Figure 7A:
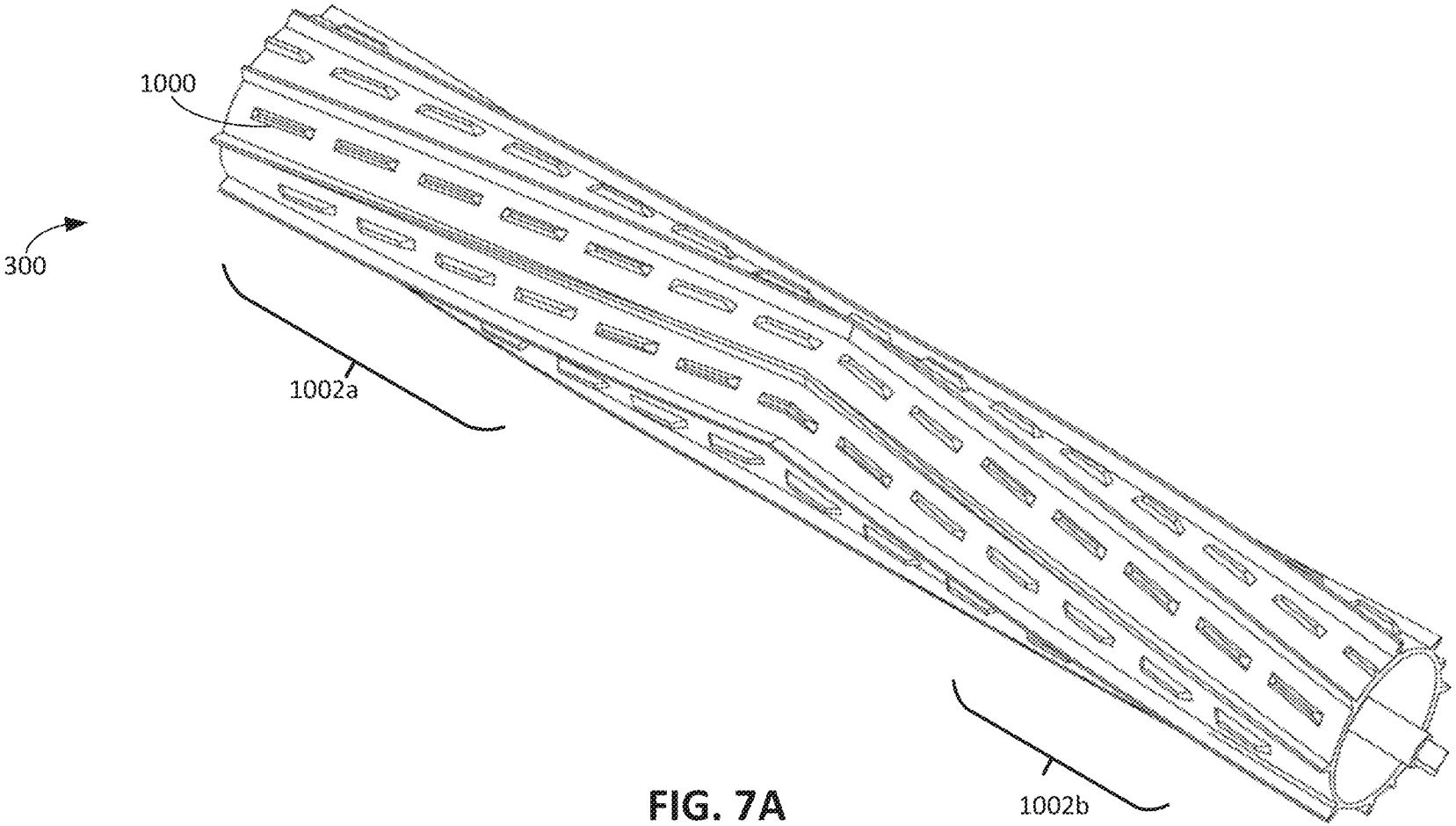
FIGS. 7A, 7B, and 7C are perspective, front, and side views of an example of a cleaning roller.

The configurations of the vanes 224*a*, 224*b* are different for cleaning rollers 104, 105, respectively, and are described in greater detail with respect to FIGS. 3A and 7A-7C. As shown in FIG. 7A, rear cleaning roller 104*a* can include nubs 1000 between vanes 224*a*. In contacts, the forward cleaning roller 105 does not have nubs between vanes 224*b*. The nubs 1000 of roller 104 enable the rear cleaning roller 104 to more thoroughly engage the cleaning surface 10 and extract more debris from the cleaning surface. In some implementations, the forward cleaning roller 105 does not include nubs between the vanes 224*b*. The forward cleaning roller 105 requires less torque to rotate than the rear cleaning roller 104 because there is less engagement with the cleaning surface 10. The forward cleaning roller 105 allows larger debris to pass beneath the forward cleaning roller 105 and into the cleaning head 100, whereas the rear cleaning roller 104 prevents that debris from passing beneath the rear cleaning roller 104, trapping the debris in the cleaning head and facilitating extraction of the debris from the cleaning surface.

As shown in FIG. 1B, the rear cleaning roller 104 and the forward cleaning roller 105 are spaced from another such that the longitudinal axis 126*a* of the rear cleaning roller 104 and the longitudinal axis 126*b* of the forward cleaning roller 105 define a spacing S1. The spacing S1 is, for example, between 2 and 6 cm, e.g., between 2 and 4 cm, 4 and 6 cm, etc.

The rear cleaning roller 104 and the forward cleaning roller 105 are mounted such that the shell 222*a* of the rear cleaning roller 104 and the shell 222*b* of the forward cleaning roller 105 define the separation 108. The separation 108 is between the shell 222*a* and the shell 222*b* and extends longitudinally between the shells 222*a*, 222*b*. In particular, the outer surface of the shell 222*b* of the forward cleaning roller 105 and the outer surface of the shell 222*a* of the roller are separated by the separation 108, which varies in width along the longitudinal axes 126*a*, 126*b* of the cleaning rollers 104, 105. The separation 108 tapers toward the center 114 of the rear cleaning roller 104, e.g., toward a plane passing through centers of the both of the cleaning rollers 104, 105 and perpendicular to the longitudinal axes 126*a*, 126*b*. The separation 108 decreases in width toward the center 114.

The separation 108 is measured as a width between the outer surface of the shell 222*a* and the outer surface of the shell 222*b*. In some cases, the width of the separation 108 is measured as the closest distance between the shell 222*a* and the shell 222*b* at various points along the longitudinal axis 126*a*. The width of the separation 108 is measured along a plane through both of the longitudinal axes 126*a*, 126*b*. In this regard, the width varies such that the distance S3 between the cleaning rollers 104, 105 at their centers is greater than the distance S2 at their ends.

Referring to inset 132*a* in FIG. 1B, a length S2 of the separation 108 proximate the first end portion 110*a* of the rear cleaning roller 104 is between 2 and 10 mm, e.g., between 2 mm and 6 mm, 4 mm and 8 mm, 6 mm and 10 mm, etc. The length S2 of the separation 108, for example, corresponds to a minimum length of the separation 108 along the length L1 of the rear cleaning roller 104. Referring to inset 132*b* in FIG. 1B, a length S3 of the separation 108 proximate the center 114 of the rear cleaning roller 104 is between, for example, 5 mm and 30 mm, e.g., between 5 mm and 20 mm, 10 mm and 25 mm, 15 mm and 30 mm, etc. The length S3 is, for example, 3 to 15 times greater than the length S2, e.g., 3 to 5 times, 5 to 10 times, 10 to 15 times, etc., greater than the length S2. The length S3 of the separation 108, for example, corresponds to a maximum length of the separation 108 along the length L1 of the rear cleaning roller 104. In some cases, the separation 108 linearly increases from the center 114 of the rear cleaning roller 104 toward the end portions 110*a*, 110*b*.

The air gap 109 between the cleaning rollers 104, 105 is defined as the distance between free tips of the vanes 224*a*, 224*b* on opposing cleaning rollers 104, 105. In some examples, the distance varies depending on how the vanes 224*a*, 224*b* align during rotation. The air gap 109 between the sheaths 220*a*, 220*b* of the cleaning rollers 104, 105 varies along the longitudinal axes 126*a*, 126*b* of the cleaning rollers 104, 105. In particular, the width of the air gap 109 varies in size depending on relative positions of the vanes 224*a*, 224*b* of the cleaning rollers 104, 105. The width of the air gap 109 is defined by the distance between the outer circumferences of the sheath 220*a*, 220*b*, e.g., defined by the vanes 224*a*, 224*b*, when the vanes 224*a*, 224*b* face one another during rotation of the cleaning rollers 104, 105. The width of the air gap 109 is defined by the distance between the outer circumferences of the shells 222*a*, 222*b* when the vanes 224*a*, 224*b* of both cleaning rollers 104, 105 do not face the other roller. In this regard, while the outer circumference of the cleaning rollers 104, 105 is consistent along the lengths of the cleaning rollers 104, 105 as described herein, the air gap 109 between the cleaning rollers 104, 105 varies in width as the cleaning rollers 104, 105 rotate. In particular, while the separation 108 has a constant length during rotation of the opposing cleaning rollers 104, 105, the distance defining the air gap 109 changes during the rotation of the cleaning rollers 104, 105 due to relative motion of the vanes 224*a*, 224*b* of the cleaning rollers 104, 105. The air gap 109 will vary in width from a minimum width of 1 mm to 10 mm when the vanes 224*a*, 224*b* face one another to a maximum width of 5 mm to 30 mm when the vanes 224*a*, 224*b* are not aligned. The maximum width corresponds to, for example, the length S3 of the separation 108 at the centers of the cleaning rollers 104, 105, and the minimum width corresponds to the length of this separation 108 minus the heights of the vanes 224*a*, 224*b* at the centers of the cleaning rollers 104, 105.

Referring to FIG. 2A, in some implementations, to sweep debris 106 toward the cleaning rollers 104, 105, the robot 102 includes a brush 233 that rotates about a non-horizontal axis, e.g., an axis forming an angle between 75 degrees and 90 degrees with the floor surface 10. The non-horizontal axis, for example, forms an angle between 75 degrees and 90 degrees with the longitudinal axes 126*a*, 126*b* of the cleaning rollers 104, 105. The robot 102 includes an actuator 234 operably connected to the brush 233. The brush 233 extends beyond a perimeter of the body 200 such that the brush 233 is capable of engaging debris 106 on portions of the floor surface 10 that the cleaning rollers 104, 105 typically cannot reach.

During the cleaning operation shown in FIG. 1A, as the controller 212 operates the actuators 208*a*, 208*b* to navigate the robot 102 across the floor surface 10, if the brush 233 is present, the controller 212 operates the actuator 234 to rotate the brush 233 about the non-horizontal axis to engage debris 106 that the cleaning rollers 104, 105 cannot reach. In particular, the brush 233 is capable of engaging debris 106 near walls of the environment and brushing the debris 106 toward the cleaning rollers 104, 105. The brush 233 sweeps the debris 106 toward the cleaning rollers 104, 105 so that the debris 106 can be ingested through the separation 108 between the cleaning rollers 104, 105.

The controller 212 operates the actuators 214*a*, 214*b* to rotate the cleaning rollers 104, 105 about the axes 126*a*, 126*b*. The cleaning rollers 104, 105, when rotated, engage the debris 106 on the floor surface 10 and move the debris 106 toward the air conduit 128. As shown in FIG. 1A, the cleaning rollers 104, 105, for example, counter rotate relative to one another to cooperate in moving debris 106 through the separation 108 and toward the air conduit 128, e.g., the rear cleaning roller 104 rotates in a clockwise direction 130*a* while the forward cleaning roller 105 rotates in a counterclockwise direction 130*b*.

The controller 212 also operates the vacuum assembly 118 to generate the airflow 120. The vacuum assembly 118 is operated to generate the airflow 120 through the separation 108 such that the airflow 120 can move the debris 106 retrieved by the cleaning rollers 104, 105. The airflow 120 carries the debris 106 into the cleaning bin 122 that collects the debris 106 delivered by the airflow 120. In this regard, both the vacuum assembly 118 and the cleaning rollers 104, 105 facilitate ingestion of the debris 106 from the floor surface 10. The air conduit 128 receives the airflow 120 containing the debris 106 and guides the airflow 120 into the cleaning bin 122. The debris 106 is deposited in the cleaning bin 122. During rotation of the cleaning rollers 104, 105, the cleaning rollers 104, 105 apply a force to the floor surface 10 to agitate any debris on the floor surface 10. The agitation of the debris 106 can cause the debris 106 to be dislodged from the floor surface 10 so that the cleaning rollers 104, 105 can more contact the debris 106 and so that the airflow 120 generated by the vacuum assembly 118 can more easily carry the debris 106 toward the interior of the robot 102. As described herein, the improved torque transfer from the actuators 214*a*, 214*b* toward the outer surfaces of the cleaning rollers 104, 105 enables the cleaning rollers 104, 105 to apply more force. As a result, the cleaning rollers 104, 105 can better agitate the debris 106 on the floor surface 10 compared to rollers and brushes with reduced torque transfer or rollers and brushes that readily deform in response to contact with the floor surface 10 or with the debris 106.

Example Cleaning Rollers: Rear Roller Core

The example of the cleaning rollers 104, 105 described with respect to FIG. 2B can include additional configurations as described with respect to FIGS. 3A-3H, 4A-4F, and 5A-5F. As shown in FIG. 3B, an example of a roller 300 includes a sheath 302, a support structure 303, and a shaft 306. The roller 300, for example, corresponds to the rear roller 104 described with respect to FIGS. 1A, 1B, 2A, and 2B. The sheath 302, the support structure 303, and the shaft 306 are similar to the sheath 220*a*, the support structure 226*a*, and the shaft 228*a* described with respect to FIG. 2B. In some implementations, the sheath 220*a*, the support structure 226*a*, and the shaft 228*a* are the sheath 302, the support structure 303, and the shaft 306, respectively. As shown in FIG. 3C, an overall length L2 of the roller 300 is similar to the overall length L1 described with respect to the cleaning rollers 104, 105.

Like the rear cleaning roller 104, the cleaning roller 300 can be mounted to the cleaning robot 102. Absolute and relative dimensions associated with the cleaning robot 102, the cleaning roller 300, and their components are described herein. Some of these dimensions are indicated in the figures by reference characters such as, for example, W1, S1-S3, L1-L10, D1-D7, M1, and M2. Example values for these dimensions in implementations are described herein, for example, in the section "Example Dimensions of Cleaning Robots and Cleaning Rollers."

Referring to FIGS. 3B and 3C, the shaft 306 is an elongate member having a first outer end portion 308 and a second outer end portion 310. The shaft 306 extends from the first end portion 308 to the second end portion 310 along a longitudinal axis 312, e.g., the axis 126*a* about which the rear cleaning roller 104 is rotated (shown in FIG. 1B). The shaft 306 is, for example, a drive shaft formed from a metal material.

The first end portion 308 and the second end portion 310 of the shaft 306 are configured to be mounted to a cleaning robot, e.g., the robot 102. The second end portion 310 is configured to be mounted to a mounting device, e.g., the mounting device 216*a*. The mounting device couples the shaft 306 to an actuator of the cleaning robot, e.g., the actuator 214*a* described with respect to FIG. 2A. The first end portion 308 rotatably mounts the shaft 306 to a mounting device, e.g., the mounting device 218*a*. The second end portion 310 is driven by the actuator of the cleaning robot.

Referring to FIG. 3B, the support structure 303 is positioned around the shaft 306 and is rotationally coupled to the shaft 306. The support structure 303 includes a core 304 affixed to the shaft 306. As described herein, the core 304 and the shaft 306 are affixed to one another, in some implementations, through an insert molding process during which the core 304 is bonded to the shaft 306. Referring to FIGS. 3D and 3E, the core 304 includes a first outer end portion 314 and a second outer end portion 316, each of which is positioned along the shaft 306. The first end portion 314 of the core 304 is positioned proximate the first end portion 308 of the shaft 306. The second end portion 316 of the core 304 is positioned proximate the second end portion 310 of the shaft 306. The core 304 extends along the longitudinal axis 312 and encloses portions of the shaft 306.

Referring to FIGS. 4A-4D, in some cases, the support structure 303 further includes an elongate portion 305*a* extending from the first end portion 314 of the core 304 toward the first end portion 308 of the shaft 306 along the longitudinal axis 312 of the roller 300. The elongate portion 305*a* has, for example, a cylindrical shape. The elongate portion 305*a* of the support structure 303 and the first end portion 308 of the shaft 306, for example, are configured to be rotatably mounted to the mounting device, e.g., the mounting device 218*a*. The mounting device 218*a*, 218*b*, for example, functions as a bearing surface to enable the elongate portion 305*a*, and hence the roller 300, to rotate about its longitudinal axis 312 with relatively little frictional forces caused by contact between the elongate portion 305*a* and the mounting device.

In some cases, the support structure 303 includes an elongate portion 305*b* extending from the second end portion 314 of the core 304 toward the second end portion 310 of the shaft 306 along the longitudinal axis 312 of the roller 300. The elongate portion 305*b* of the support structure 303 and the second end portion 314 of the core 304, for example, are coupled to the mounting device, e.g., the mounting device 216*a*. The mounting device 216*a* enables the roller 300 to be mounted to the actuator of the cleaning robot, e.g., rotationally coupled to a motor shaft of the actuator. The elongate portion 305*b* has, for example, a prismatic shape having a non-circular cross-section, such as a square, hexagonal, or other polygonal shape, that rotationally couples the support structure 303 to a rotatable mounting device, e.g., the mounting device 216*a*. The elongate portion 305*b* engages with the mounting device 216*a* to rotationally couple the support structure 303 to the mounting device 216*a*.

The mounting device 216*a* (e.g., of FIG. 2B) rotationally couples both the shaft 306 and the support structure 303 to the actuator of the cleaning robot, thereby improving torque transfer from the actuator to the shaft 306 and the support structure 303. The shaft 306 can be attached to the support structure 303 and the sheath 302 in a manner that improves torque transfer from the shaft 306 to the support structure 303 and the sheath 302. Referring to FIGS. 3C and 3E, the sheath 302 is affixed to the core 304 of the support structure 303. As described herein, the support structure 303 and the sheath 302 are affixed to one another to rotationally couple the sheath 302 to the support structure 303, particularly in a manner that improves torque transfer from the support structure 303 to the sheath 302 along the entire length of the interface between the sheath 302 and the support structure 303. The sheath 302 is affixed to the core 304, for example, through an overmold or insert molding process in which the core 304 and the sheath 302 are directly bonded to one another. In addition, in some implementations, the sheath 302 and the core 304 include interlocking geometry that ensures that rotational movement of the core 304 drives rotational movement of the sheath 302.

The sheath 302 includes a first half 322 and a second half 324. The first half 322 corresponds to the portion of the sheath 302 on one side of a central plane 327 passing through a center 326 of the roller 300 and perpendicular to the longitudinal axis 312 of the roller 300. The second half 324 corresponds to the other portion of the sheath 302 on the other side of the central plane 327. The central plane 327 is, for example, a bisecting plane that divides the roller 300 into two symmetric halves. In this regard, the fixed portion 331 is centered on the bisecting plane.

The sheath 302 includes a first outer end portion 318 on the first half 322 of the sheath 302 and a second outer end portion 320 on the second half 324 of the sheath 302. The sheath 302 extends beyond the core 304 of the support structure 303 along the longitudinal axis 312 of the roller 300, in particular, beyond the first end portion 314 and the second end portion 316 of the core 304. In some cases, the sheath 302 extends beyond the elongate portion 305*a* along the longitudinal axis 312 of the roller 300, and the elongate portion 305*b* extends beyond the second end portion 320 of the sheath 302 along the longitudinal axis 312 of the roller 300.

In some cases, a fixed portion 331*a* of the sheath 302 extending along the length of the core 304 is affixed to the support structure 303, while free portions 331*b*, 331*c* of the sheath 302 extending beyond the length of the core 304 are not affixed to the support structure 303. The fixed portion 331*a* extends from the central plane 327 along both directions of the longitudinal axis 312, e.g., such that the fixed portion 331*a* is symmetric about the central plane 327. The free portion 331*b* is fixed to one end of the fixed portion 331*a*, and the free portion 331*c* is fixed to the other end of the fixed portion 331*a*.

In some implementations, the fixed portion 331*a* tends to deform relatively less than the free portions 331*b*, 331*c* when the sheath 302 of the roller 300 contacts objects, such as the floor surface 10 and debris on the floor surface 10. In some cases, the free portions 331*b*, 331*c* of the sheath 302 deflect in response to contact with the floor surface 10, while the fixed portions 331*b*, 331*c* are radially compressed. The amount of radially compression of the fixed portions 331*b*, 331*c* is less than the amount of radial deflection of the free portions 331*b*, 331*c* because the fixed portions 331*b*, 331*c* include material that extends radially toward the shaft 306. As described herein, in some cases, the material forming the fixed portions 331*b*, 331*c* contacts the shaft 306 and the core 304.

The sheath 302 extends to the edges of the cleaning head 100 to maximize the coverage of the cleaning head on the cleaning surface 10. The sheath 302 extends across a lateral axis of the bottom of the cleaning robot 102 within 5% of a side edge of the bottom of the cleaning robot 102. In some implementations, the sheath 302 extends more than 90% across the lateral length of the cleaning head 100. In some implementations, the sheath 302 extends within 1 cm of the side edge of the bottom of the robot 102. In some implementations, the sheath 302 extends within 1-5 cm, 2-5 cm, or between 3-5 cm from the side edge of the bottom of the robot.

The first collection well 328 is positioned within the first half 322 of the sheath 302. The first collection well 328 is, for example, defined by the first end portion 314 of the core 304, the elongate portion 305*a* of the support structure 303, the free portion 331*b* of the sheath 302, and the shaft 306. The first end portion 314 of the core 304 and the free portion 331*b* of the sheath 302 define a length L5 of the first collection well 328.

The second collection well 330 is positioned within the second half 324 of the sheath 302. The second collection well 330 is, for example, defined by the second end portion 316 of the core 304, the free portion 331*c* of the sheath 302, and the shaft 306. The second end portion 316 of the core 304 and the free portion 331*c* of the sheath 302 define a length L5 of the second collection well 330.

Figure 4A:
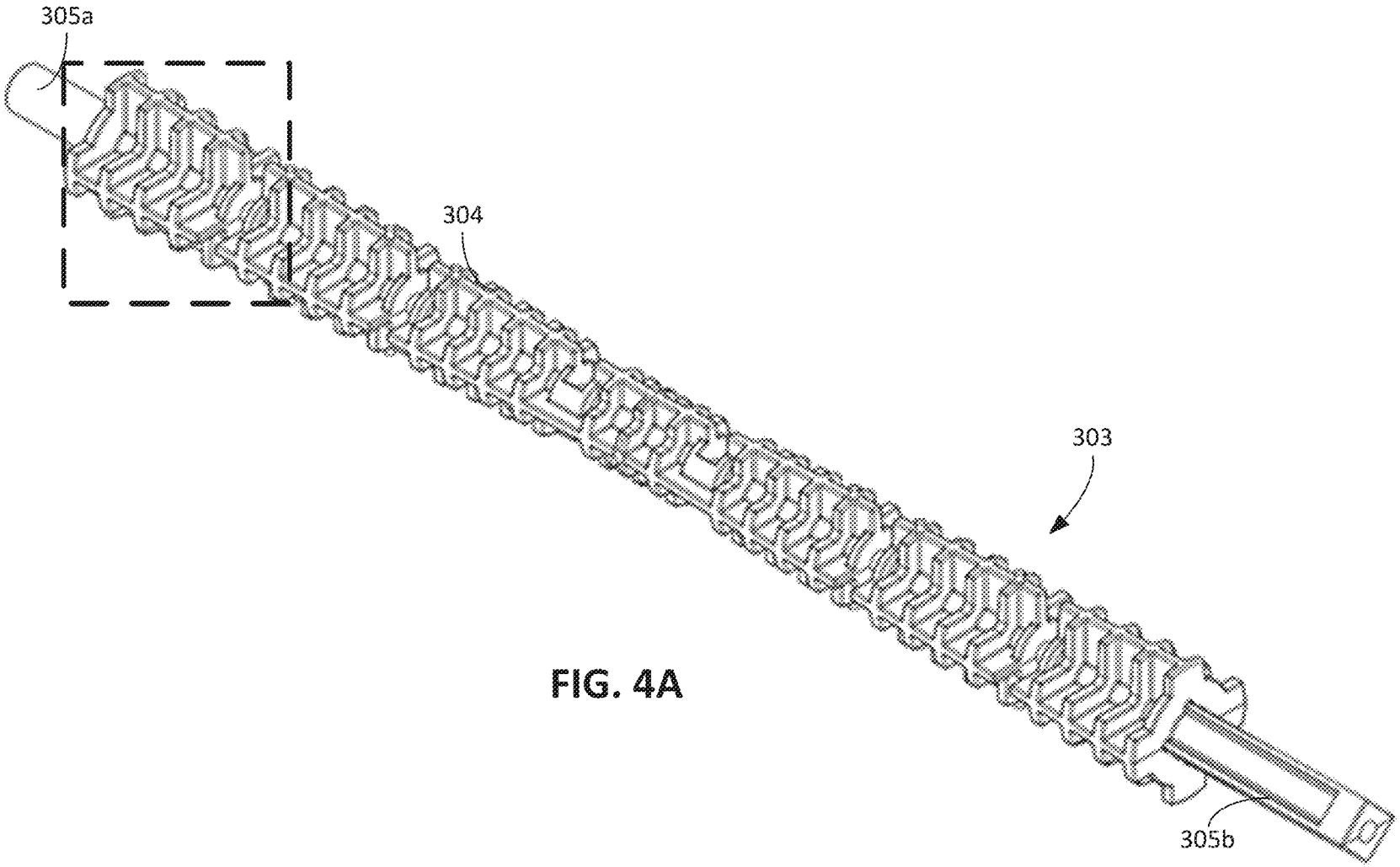
FIG. 4A is a perspective view of a support structure of the cleaning roller of FIG. 3A.
Figure 4B:
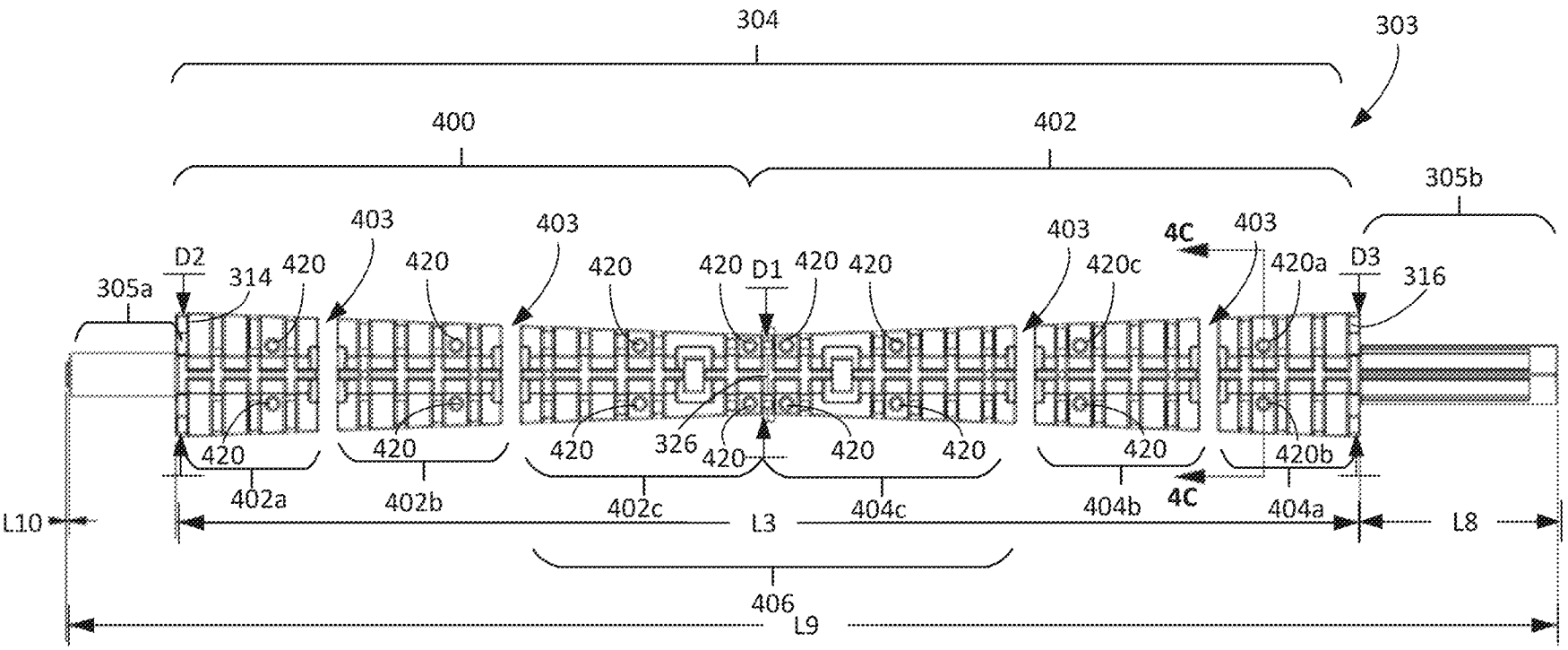
FIG. 4B is a front view of the support structure of FIG. 4A.

Referring to FIGS. 4A and 4B, a core 304 includes a first half 400 including the first end portion 314 and a second half 402 including the second end portion 316. The first half 400 and the second half 402 of the core 304 are symmetric about the central plane 327.

The first half 400 tapers along the longitudinal axis 312 toward the center 326 of the roller 300, and the second half 402 tapers toward the center 326 of the roller 300, e.g., toward the central plane 327. In some implementations, the first half 400 of the core 304 tapers from the first end portion 314 toward the center 326, and the second half 402 of the core 304 tapers along the longitudinal axis 312 from the second end portion 316 toward the center 326. In some cases, the core 304 tapers toward the center 326 along an entire length L3 of the core 304. In some cases, an outer diameter D1 of the core 304 near or at the center 326 of the roller 300 is smaller than outer diameters D2, D3 of the core 304 near or the first and second end portions 314, 316 of the core 304. The outer diameters of the core 304, for example, linearly decreases along the longitudinal axis 312 of the roller 300, e.g., from positions along the longitudinal axis 312 at both of the end portions 314, 316 to the center 326.

In some implementations, the core 304 of the support structure 303 tapers from the first end portion 314 and the second end portion 316 toward the center 326 of the roller 300, and the elongate portions 305*a*, 305*b* are integral to the core 304. The core 304 is affixed to the shaft 306 along the entire length L3 of the core 304. By being affixed to the core 304 along the entire length L3 of the core 304, torque applied to the core 304 and/or the shaft 306 can transfer more evenly along the entire length L3 of the core 304.

In some implementations, the support structure 303 is a single monolithic component in which the core 304 extends along the entire length of the support structure 303 without any discontinuities. The core 304 is integral to the first end portion 314 and the second end portion 316. Alternatively, referring to FIG. 4B, the core 304 includes multiple discontinuous sections that are positioned around the shaft 306, positioned within the sheath 302, and affixed to the sheath 302. The first half 400 of the core 304 includes, for example, multiple sections 402*a*, 402*b*, 402*c*. The sections 402*a*, 402*b*, 402*c* are discontinuous with one another such that the core 304 includes gaps 403 between the sections 402*a*, 402*b* and the sections 402*b*, 402*c*. Each of the multiple sections 402*a*, 402*b*, 402*c* is affixed to the shaft 306 so as to improve torque transfer from the shaft 306 to the core 304 and the support structure 303. In this regard, the shaft 306 mechanically couples each of the multiple sections 402*a*, 402*b*, 402*c* to one another such that the sections 402*a*, 402*b*, 402*c* jointly rotate with the shaft 306. Each of the multiple sections 402*a*, 402*b*, 402*c* is tapered toward the center 326 of the roller 300. The multiple sections 402*a*, 402*b*, 402*c*, for example, each taper away from the first end portion 314 of the core 304 and taper toward the center 326. The elongate portion 305*a* of the support structure 303 is fixed to the section 402*a* of the core 304, e.g., integral to the section 402*a* of the core 304.

Similarly, the second half 402 of the core 304 includes, for example, multiple sections 404*a*, 404*b*, 404*c* discontinuous with one another such that the core 304 includes gaps 403 between the sections 404*a*, 404*b* and the sections 404*b*, 404*c*. Each of the multiple sections 404*a*, 404*b*, 404*c* is affixed to the shaft 306. In this regard, the shaft 306 mechanically couples each of the multiple sections 404*a*, 404*b*, 404*c* to one another such that the sections 404*a*, 404*b*, 404*c* jointly rotate with the shaft 306. The second half 402 of the core 304 accordingly rotates jointly with the first half 400 of the core 304. Each of the multiple sections 404*a*, 404*b*, 404*c* is tapered toward the center 326 of the roller 300. The multiple sections 404*a*, 404*b*, 404*c*, for example, each taper away from the second end portion 314 of the core 304 and taper toward the center 326. The elongate portion 305*b* of the support structure 303 is fixed to the section 404*a* of the core 304, e.g., integral to the section 404*a* of the core 304.

In some cases, the section 402*c* of the first half 400 closest to the center 326 and the section 404*c* of the second half 402 closest to the center 326 are continuous with one another. The section 402*c* of the first half 400 and the section 404*c* of the second half 402 form a continuous section 406 that extends from the center 326 outwardly toward both the first end portion 314 and the second end portion 316 of the core 304. In such examples, the core 304 includes five distinct, discontinuous sections 402*a*, 402*b*, 406, 404*a*, 404*b*. Similarly, the support structure 303 includes five distinct, discontinuous portions. The first of these portions includes the elongate portion 305*a* and the section 402*a* of the core 304. The second of these portions corresponds to the section 402*b* of the core 304. The third of these portions corresponds to the continuous section 406 of the core 304. The fourth of these portions corresponds to the section 404*b* of the core 304. The fifth of these portions includes the elongate portion 305*b* and the section 404*a* of the core 304. While the core 304 and the support structure 303 are described as including five distinct and discontinuous portions, in some implementations, the core 304 and the support structure 303 include fewer or additional discontinuous portions.

Figure 4D:
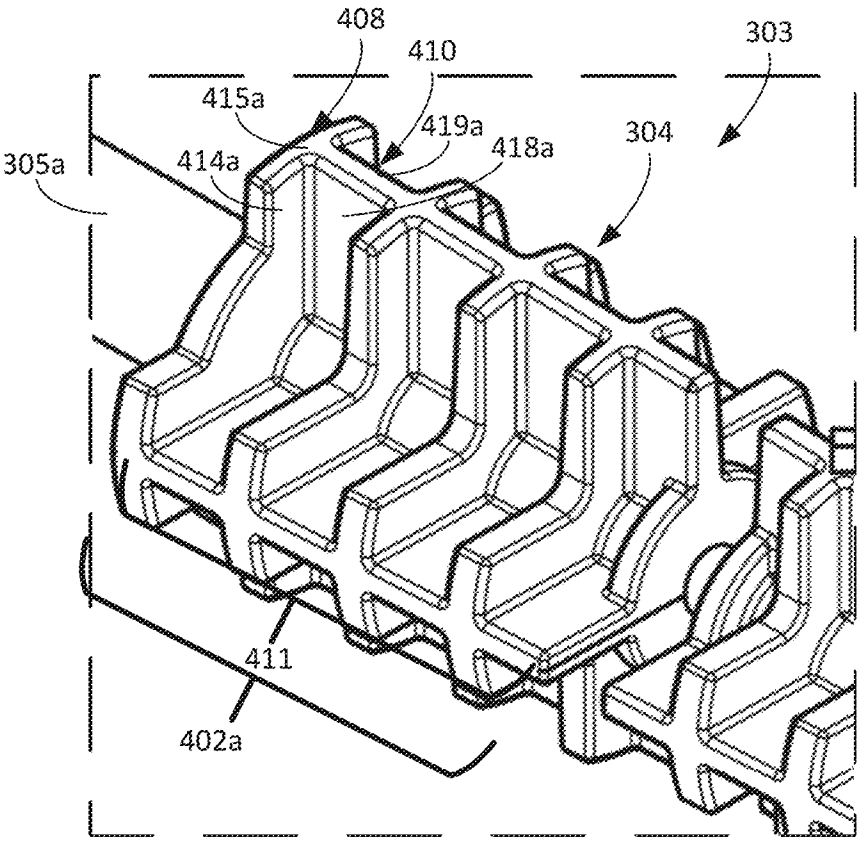
FIG. 4D is a zoomed in perspective view of an inset 4D marked in FIG. 4A depicting an end portion of the subassembly of FIG. 4A.
Figure 4C:
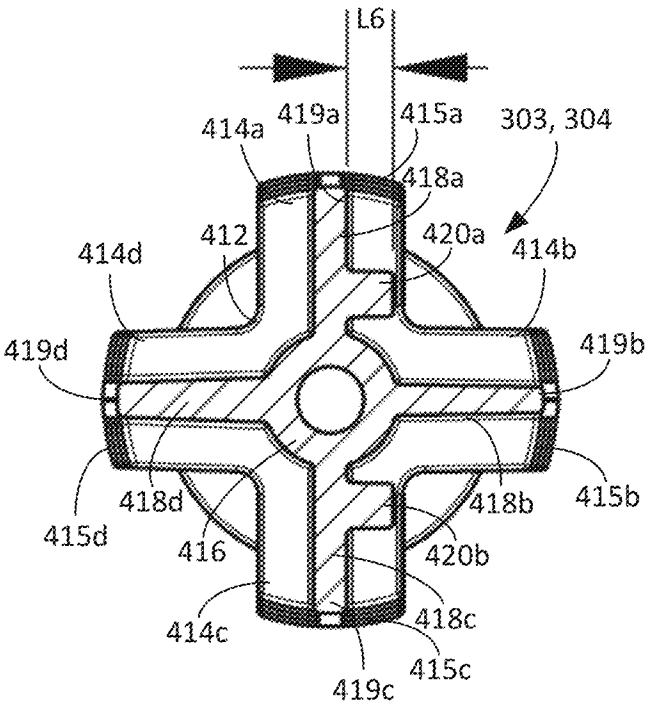
FIG. 4C is a cross sectional view of an end portion of the support structure of FIG. 4B taken along section 4C-4C shown in FIG. 4B.

Referring to both FIGS. 4C and 4D, the first end portion 314 of the core 304 includes alternating ribs 408, 410. The ribs 408, 410 each extend radially outwardly away from the longitudinal axis 312 of the roller 300. The ribs 408, 410 are continuous with one another and form the section 402*a*.

The transverse rib 408 extends transversely relative to the longitudinal axis 312. The transverse rib 408 includes a ring portion 412 fixed to the shaft 306 and lobes 414*a*-414*d* extending radially outwardly from the ring portion 412. In some implementations, the lobes 414*a*-414*d* are axisymmetric about the ring portion 412, e.g., axisymmetric about the longitudinal axis 312 of the roller 300.

The longitudinal rib 410 extends longitudinal along the longitudinal axis 312. The rib 410 includes a ring portion 416 fixed to the shaft 306 and lobes 418*a*-418*d* extending radially outwardly from the ring portion 416. The lobes 418*a*-418*d* are axisymmetric about the ring portion 416, e.g., axisymmetric about the longitudinal axis 312 of the roller 300.

The ring portion 412 of the rib 408 has a wall thickness greater than a wall thickness of the ring portion 416 of the rib 410. The lobes 414*a*-414*d* of the rib 408 have wall thicknesses greater than wall thicknesses of the lobes 418*a*-418*d* of the rib 410.

Free ends 415*a*-415*d* of the lobes 414*a*-414*d* define outer diameters of the ribs 408, and free ends 419*a*-419*d* of the lobes 418*a*-418*d* define outer diameters of the ribs 410. A distance between the free ends 415*a*-415*d*, 419*a*-419*d* and the longitudinal axis 312 define widths of the ribs 408, 410. In some cases, the widths are outer diameters of the ribs 408, 410. The free ends 415*a*-415*d*, 419*a*-419*d* are arcs coincident with circles centered along the longitudinal axis 312, e.g., are portions of the circumferences of these circles. The circles are concentric with one another and with the ring portions 412, 416. In some cases, an outer diameter of ribs 408, 410 closer to the center 326 is greater than an outer diameter of ribs 408, 410 farther from the center 326. The outer diameters of the ribs 408, 410 decrease linearly from the first end portion 314 to the center 326, e.g., to the central plane 327. In particular, as shown in FIG. 4D, the ribs 408, 410 form a continuous longitudinal rib 411 that extends along a length of the section 402*a*. The rib extends radially outwardly from the longitudinal axis 312. The height of the rib 411 relative to the longitudinal axis 312 decreases toward the center 327. The height of the rib 411, for example, linearly decreases toward the center 327.

In some implementations, referring also to FIG. 4B, the core 304 of the support structure 303 includes posts 420 extending away from the longitudinal axis 312 of the roller 300. The posts 420 extend, for example, from a plane extending parallel to and extending through the longitudinal axis 312 of the roller 300. As described herein, the posts 420 can improve torque transfer between the sheath 302 and the support structure 303. The posts 420 extend into the sheath 302 to improve the torque transfer as well as to improve bond strength between the sheath 302 the support structure 303. The posts 420 can stabilize and mitigate vibration in the roller 300 by balancing mass distribution throughout the roller 300.

In some implementations, the posts 420 extend perpendicular to a rib of the core 304, e.g., perpendicular to the lobes 418*a*, 418*c*. The lobes 418*a*, 418*c*, for example, extend perpendicularly away from the longitudinal axis 312 of the roller 300, and the posts 420 extend from the lobe 418*a*, 418*c* and are perpendicular to the lobes 418*a*, 418*c*. The posts 420 have a length L6, for example, between 0.5 and 4 mm, e.g., 0.5 to 2 mm, 1 mm to 3 mm, 1.5 mm to 3 mm, 2 mm to 4 mm, etc.

In some implementations, the core 304 includes multiple posts 420*a*, 420*b* at multiple positions along the longitudinal axis 312 of the roller 300. The core 304 includes, for example, multiple posts 420*a*, 420*c* extending from a single transverse plane perpendicular to the longitudinal axis 312 of the roller 300. The posts 420*a*, 420*c* are, for instance, symmetric to one another along a longitudinal plane extending parallel to and extending through the longitudinal axis 312 of the roller 300. The longitudinal plane is distinct from and perpendicular to the transverse plane from which the posts 420*a*, 420*c* extend. In some implementations, the posts 420*a*, 420*c* at the transverse plane are axisymmetrically arranged about the longitudinal axis 312 of the roller 300.

While four lobes are depicted for each of the ribs 408, 410, in some implementations, the ribs 408, 410 include fewer or additional lobes. While FIGS. 4C and 4D are described with respect to the first end portion 314 and the section 402*a* of the core 304, the configurations of the second end portion 316 and the other sections 402*b*, 402*c*, and 404*a*-404*c* of the core 304 may be similar to the configurations described with respect to the examples in FIGS. 4C and 4D. The first half 400 of the core 304 is, for example, symmetric to the second half 402 about the central plane 327.

Example Cleaning Rollers: Front Roller Core

Figure 3A:
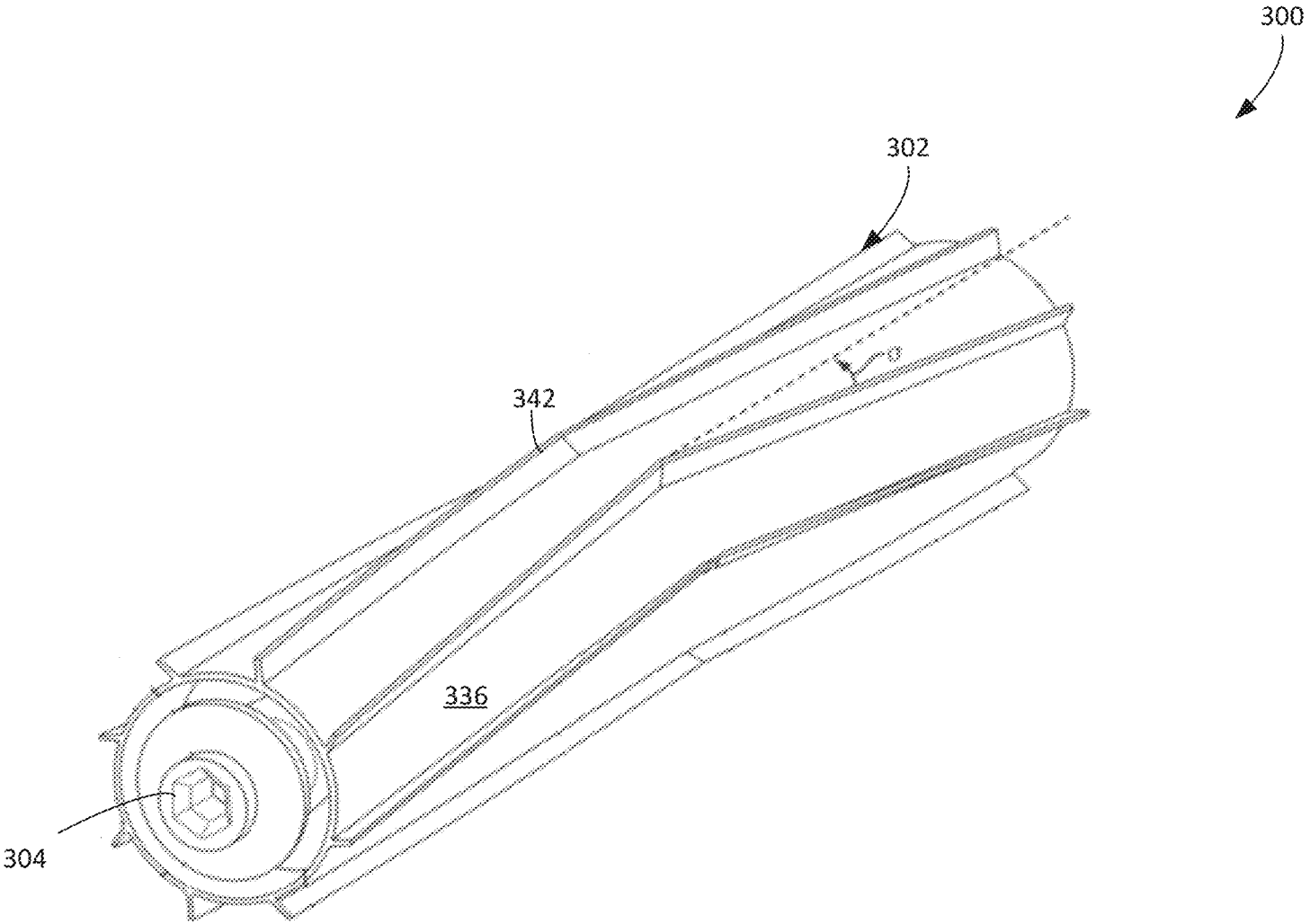
FIG. 3A is a front perspective view of a cleaning roller.
Figure 3B:
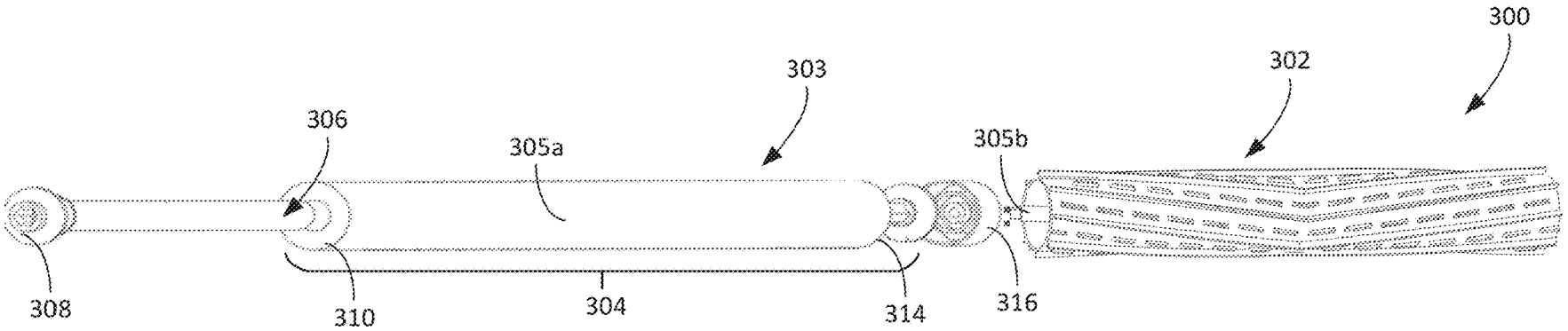
FIG. 3B is a front perspective exploded view of the cleaning roller of FIG. 3A.
Figure 3C:
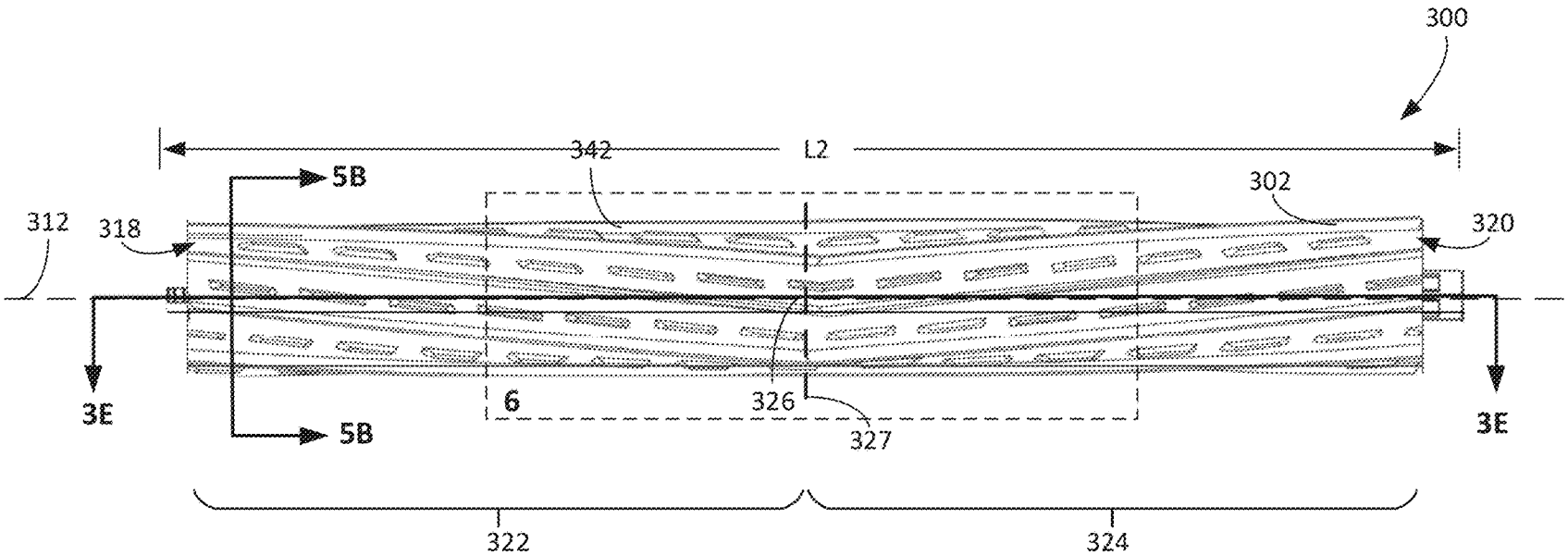
FIG. 3C is a front view of the cleaning roller of FIG. 3A.
Figure 3D:
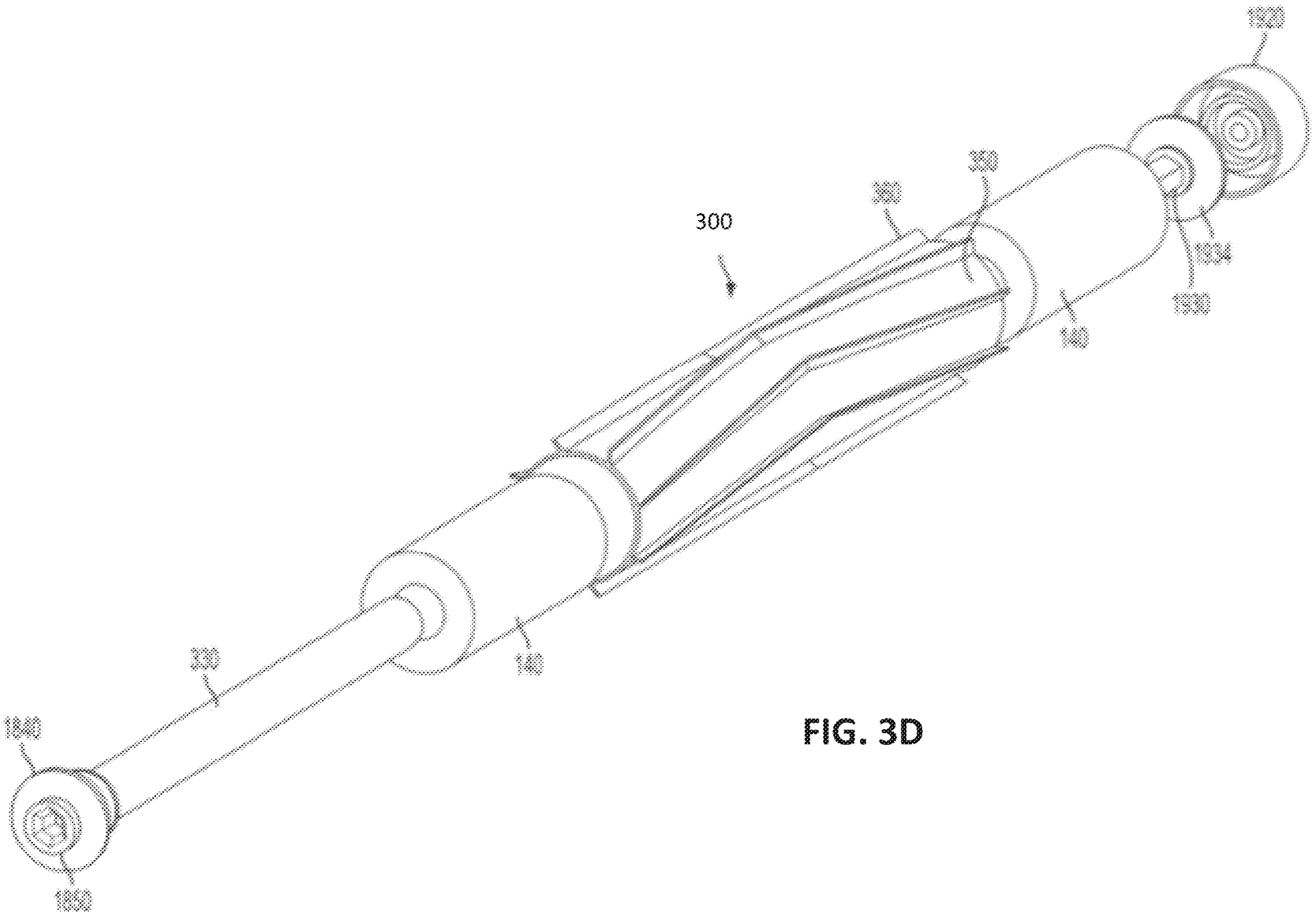
FIG. 3D is a perspective view of the cleaning roller of FIG. 3A.
Figure 3E:
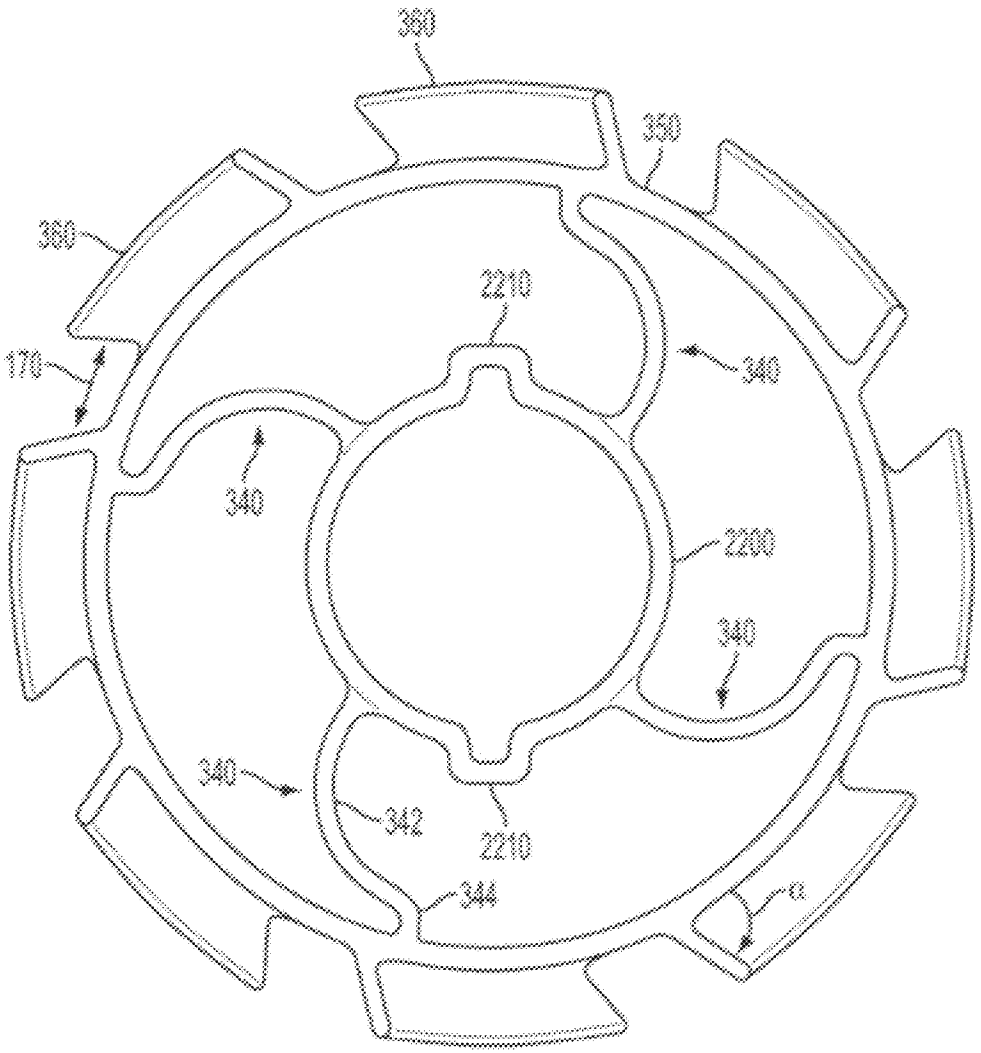
FIG. 3E is a cross-sectional view of the sheath of the cleaning roller of FIG. 3A.
Figure 3F:
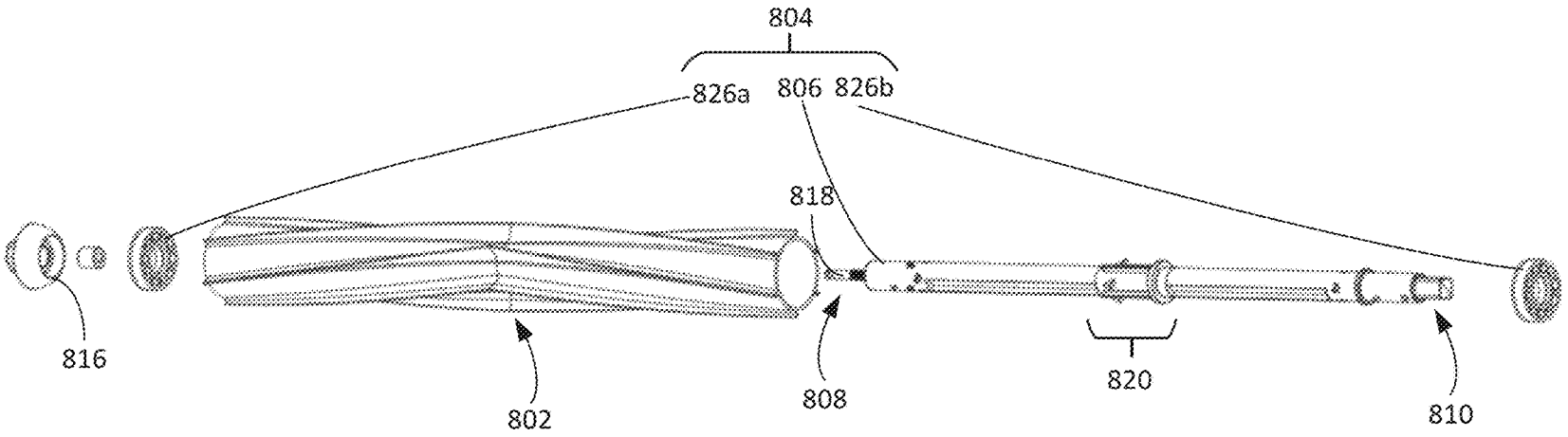
FIG. 3F is a front perspective exploded view of a cleaning roller.
Figure 3G:
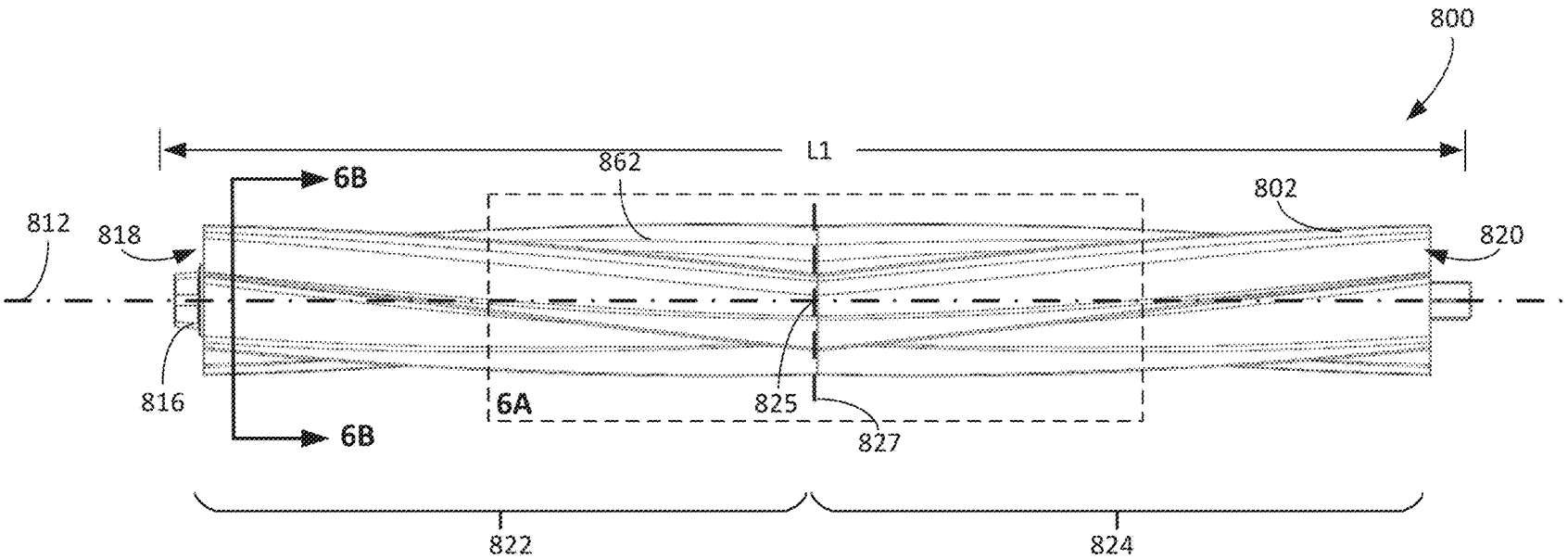
FIG. 3G is a front view of the cleaning roller of FIG. 3F.

FIGS. 3A and 3F show an example of a roller 800 including an outer sheath 802 and an internal support structure 804. The roller 800, for example, corresponds to the front roller 105 described with respect to FIGS. 1A, 1B, 2A, and 2B. The sheath 802 and the support structure 804 are similar to the sheath 220*a* and the support structure 226*a* of the front roller 105. As shown in FIG. 3C, an overall length of the roller 800 is similar to the overall length described with respect to the cleaning rollers 104, 105. For example, the roller 800 has a length L1. Like the forward cleaning roller 105, the roller 800 can be mounted to the robot 102 and can be part of the cleaning head 100.

Figure 4E:
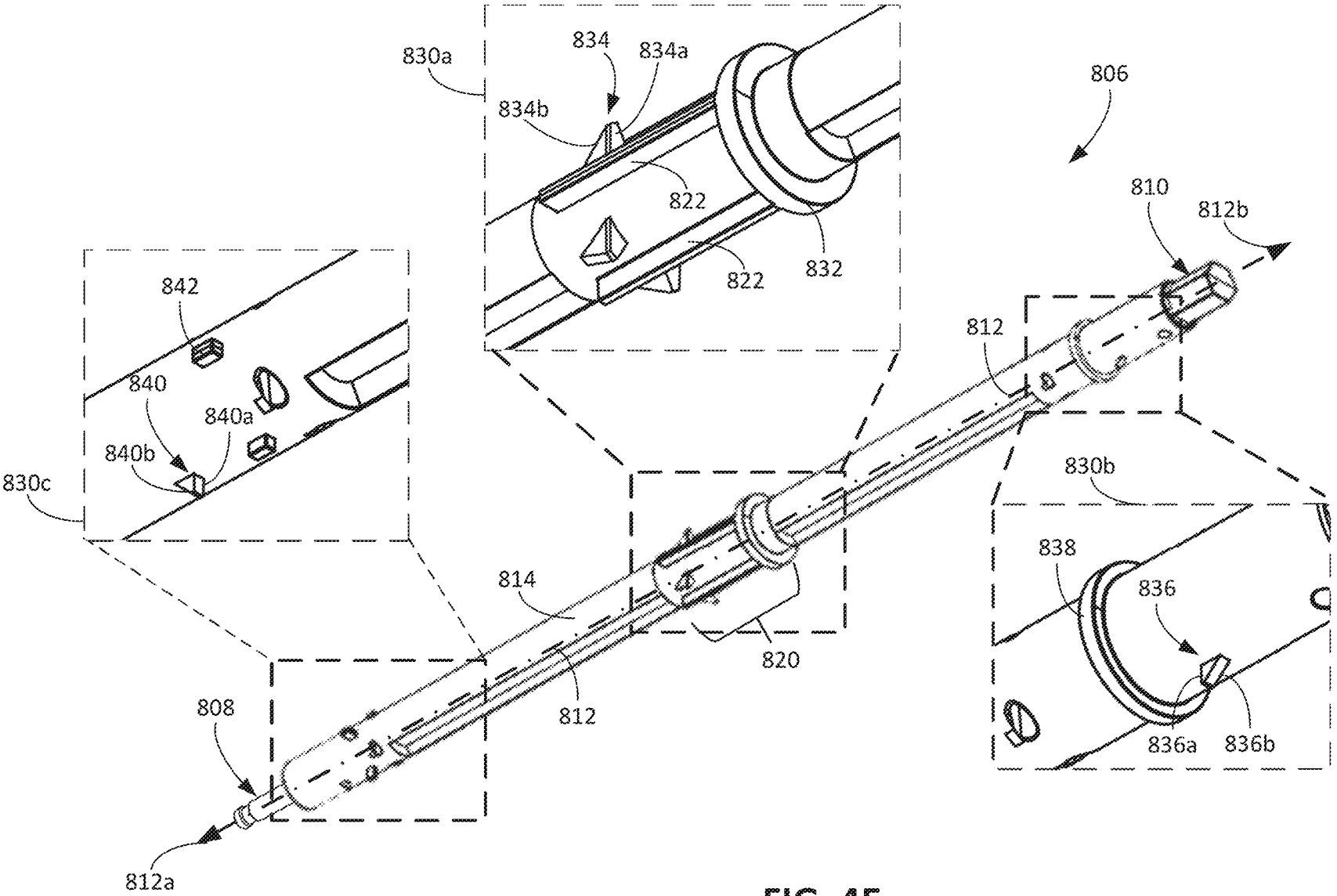
FIG. 4E is a perspective view of a core of the cleaning roller of FIG. 3F.
Figure 4F:
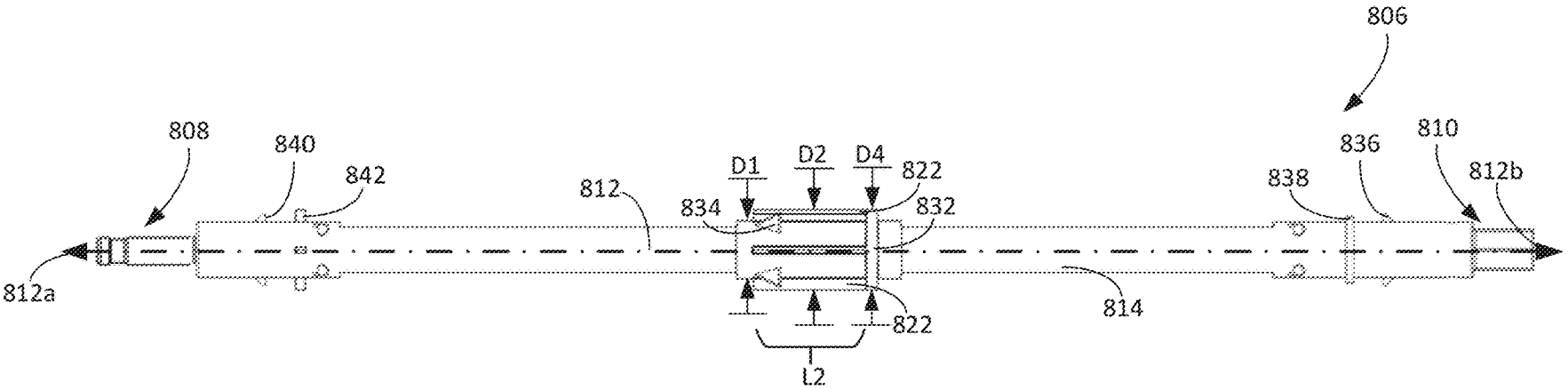
FIG. 4F is a front view of the core of the cleaning roller of FIG. 3F.

Referring to FIG. 3F, the support structure 804 includes an elongate core 806 having a first outer end portion 808 and a second outer end portion 810. Referring to FIGS. 4E and 4F, the core 806 extends from the first end portion 808 to the second end portion 810 along a longitudinal axis 812, e.g., the longitudinal axis 126*a* about which the rear cleaning roller 104 is rotated.

A shaft portion 814 of the core 806 extends from the first end portion 808 to the second end portion 810 and has an outer diameter D1 (shown in FIG. 4F) between 5 mm and 15 mm, e.g., between 5 and 10 mm, 7.5 mm and 12.5 mm, or 10 mm and 15 mm. At least a portion of an outer surface of the shaft portion 814 between the first end portion 808 and the second end portion 810 is a substantially cylindrical portion of the core 806. As described herein, features are arranged circumferentially about this portion of the outer surface of the shaft portion 814 to enable the core 806 to be interlocked with the sheath 802.

The first end portion 808 and the second end portion 810 of the core 806 are configured to be mounted to a cleaning robot, e.g., the robot 102, to enable the roller 800 to be rotated relative to the body 200 of the robot 102 about the longitudinal axis 812. The second end portion 810 is an elongate member engageable with an actuation system of the robot 102, e.g., so that the actuator 214 of the robot 102 can be used to drive the roller 800. The second end portion 810 has a non-circular cross-section to mate with an engagement portion of the drive mechanism driven by the actuator 214 of the robot 102. For example, the cross-section of the second end portion 810 has a prismatic shape having a square, rectangular, hexagonal, pentagonal, another polygonal cross-sectional shape, a Reuleaux polygonal cross-sectional shape, or other non-circular cross-sectional shape. The second end portion 810 is driven by the actuator of the robot 102 such that the core 806 rotates relative to the body 200 of the robot 102 and the housing 124 of the cleaning head 100. In particular, the core 806 rotationally couples the roller 800 to the actuator 214 of the robot 102. As described herein, the sheath 802 is rotationally coupled to the core 806 such that the sheath 802 is rotated relative to the floor surface 10 in response to rotation of the core 806. The sheath 802, which defines the outer surface of the roller 800, contacts debris on the floor surface 10 and rotates to cause the debris to be drawn into the robot 102.

Referring back to FIGS. 3F and 3G, a mounting device 816 (similar to the mounting device 218*a*) is on the first end portion 808 of the core 806. The mounting device 816 is rotatably coupled to the first end portion 808 of the core 806. For example, the first end portion 808 of the core 806 includes a rod member 818 (shown in FIG. 3F and, e.g., similar to the rod member 234*a*) that is rotatably coupled to the mounting device 816. The core 806 and the rod member 818 are affixed to one another, in some implementations, through an insert molding process during which the core 806 is bonded to the rod member 818. During rotation of the roller 800, the mounting device 816 is rotationally fixed to the body 200 of the robot 102 or the housing 124 of the cleaning head 100, and the rod member 818 rotates relative to the mounting device 816. The mounting device 816 functions as a bearing surface to enable the core 806 and the rod member 818 to rotate about its longitudinal axis 812 with relatively small frictional forces caused by contact between the rod member 818 and the mounting device 816.

Figure 3H:
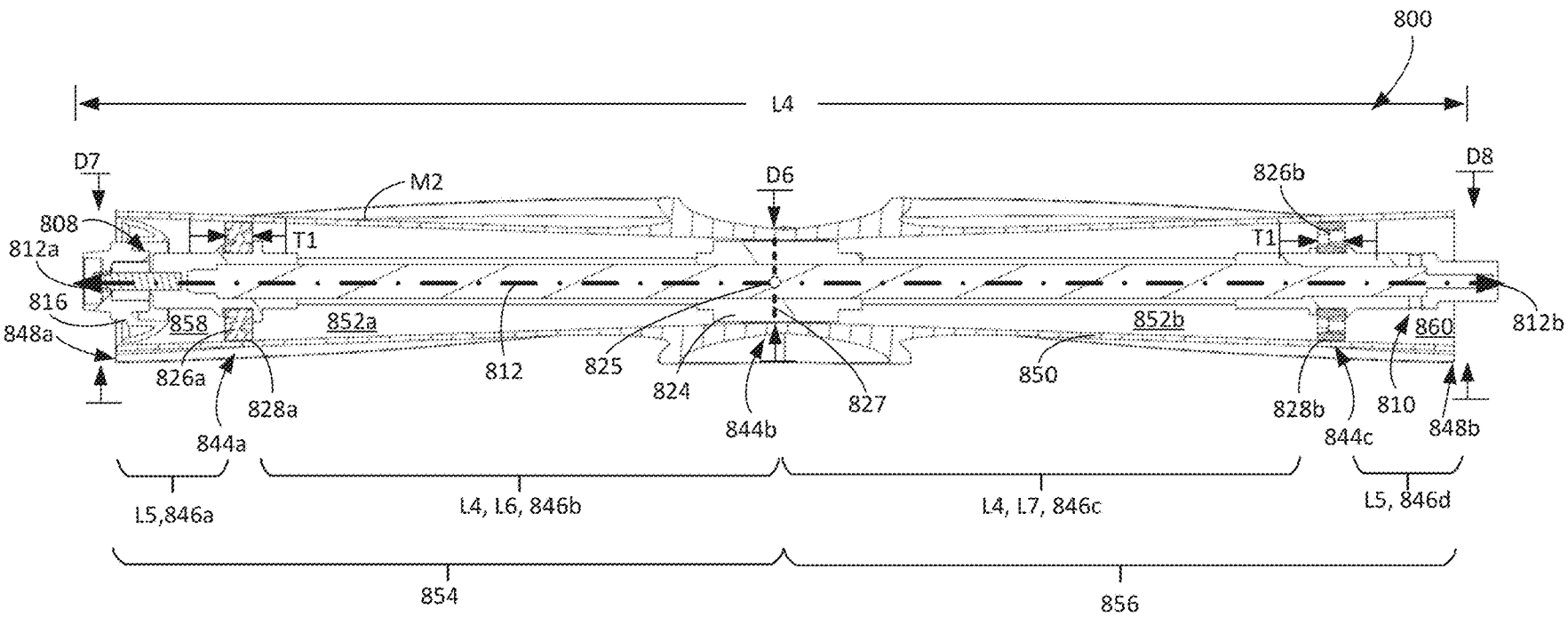
FIG. 3H a front cross-sectional view of the cleaning roller of FIG. 3F.

The core 806 is rotationally coupled to the sheath 802 so that rotation of the core 806 results in rotation of the sheath 802. Referring to FIGS. 3F and 3H, the core 806 is rotationally coupled to the sheath 802 at a central portion 820 of the core 806. The central portion 820 includes features that transfer torque from the core 806 to the sheath 802. The central portion 820 is interlocked with the sheath 802 to rotationally couple the core 806 to the sheath 802.

Example Cleaning Rollers: Rear Roller Sheath

A sheath 302 positioned around the core 304 has a number of appropriate configurations. FIGS. 3A-3E depict one example configuration. The sheath 302 includes a shell 336 surrounding and affixed to the core 304. The shell 336 include a first half 338 and a second half 340 symmetric about the central plane 327. The first half 322 of the sheath 302 includes the first half 338 of the shell 336, and the second half 324 of the sheath 302 includes the second half 340 of the shell 336.

FIG. 3D illustrates a side perspective exploded view of the rear cleaning roller 300. The axle 330 is shown, along with the flanges 1840 and 1850 of its driven end. The axle insert 1930 and flange 1934 of the non-driven end are also shown, along with the shroud 1920 of the non-driven end. Two foam inserts 140 are shown, which fit into the tubular tube 350 to provide a collapsible, resilient core for the tube. In certain embodiments, the foam inserts can be replaced by curvilinear spokes. The curvilinear spokes can support the central portion of the roller 300, between the two foam inserts 140 and can, for example, be integrally molded with the roller tube 350 and chevron vane 360.

FIG. 3E illustrates a cross sectional view of an exemplary roller 300 having curvilinear spokes 340 supporting the chevron vane tube 350. As shown, the curvilinear spokes can have a first (inner) portion 342 curvilinear in a first direction, and a second (outer) portion 344 that is either lacks curvature or curves in an opposite direction. The relative lengths of the portions can vary and can be selected based on such factors as molding requirements and desired firmness/collapsibility/resiliency. A central hub 2200 of the roller can be sized and shaped to mate with the axle that drives the roller (e.g., axle 330 of FIG. 3D). To transfer rotational torque from the axle to the roller, the illustrated roller includes two recesses or engagement elements/receptacles 2210 that are configured to receive protrusions or keys 335 of the axle. One skilled in the art will understand that other methods exist for mating the axle and the roller that will transfer rotational torque from the axle to the roller.

In certain embodiments of the present teachings, the one or more vanes are integrally formed with the resilient tubular member and define V-shaped chevrons extending from one end of the resilient tubular member to the other end. In one embodiment, the one or more chevron vanes are equidistantly spaced around the circumference of the resilient tube member. In one embodiment, the vanes are aligned such that the ends of one chevron are coplanar with a central tip of an adjacent chevron. This arrangement provides constant contact between the chevron vanes and a contact surface with which the compressible roller engages. Such uninterrupted contact eliminates noise otherwise created by varying between contact and no contact conditions. In one implementation, the one or more chevron vanes extend from the outer surface of the tubular roller at an angle $\alpha$ between 30° and 60° relative to a radial axis and inclined toward the direction of rotation (see FIG. 3D). In one embodiment the angle $\alpha$ of the chevron vanes is 45° to the radial axis. Angling the chevron vanes in the direction of rotation reduces stress at the root of the vane, thereby reducing or eliminating the likelihood of vane tearing away from the resilient tubular member. The one or more chevron vanes contact debris on a cleaning surface and direct the debris in the direction of rotation of the compressible roller.

In one implementation, the vanes are V-shaped chevrons and the legs of the V are at a 5° to 10° angle $\theta$ relative a linear path traced on the surface of the tubular member and extending from one end of the resilient tubular member to the other end. In one embodiment, the two legs of the V-shaped chevron are at an angle $\theta$ of 7°. By limiting the angle $\theta$ to less than 10° the compressible roller is manufacturable by molding processes. Angles steeper than 10° create failures in manufacturability for elastomers having a durometer harder than 80 A. In one embodiment, the tubular member and curvilinear spokes and hub are injection molded from a resilient material of a durometer between 60 and 80 A. A soft durometer material than this range may exhibit premature wear and catastrophic rupture and a resilient material of harder durometer will create substantial drag (i.e. resistance to rotation) and will result in fatigue and stress fracture. In one embodiment, the resilient tubular member is manufactured from TPU and the wall of the resilient tubular member has a thickness of about 1 mm. In one embodiment, the inner diameter of the resilient tubular member is about 23 mm and the outer diameter is about 25 mm. In one embodiment of the resilient tubular member having a plurality of chevron vanes, the diameter of the outside circumference swept by the tips of the plurality of vanes is 30 mm.

Because the one or more chevron vanes extend from the outer surface of the resilient tubular member by a height that is, in one embodiment, at least 10% of the diameter of the resilient tubular roller, they prevent cord like elements from directly wrapping around the outer surface of the resilient tubular member. The one or more vanes therefore prevent hair or other string like debris from wrapping tightly around the core of the compressible roller and reducing efficacy of cleaning. Defining the vanes as V-shaped chevrons further assists with directing hair and other debris from the ends of a roller toward the center of the roller, where the point of the V-shaped chevron is located. In one embodiment the V-shaped chevron point is located directly in line with the center of a vacuum inlet of the autonomous coverage robot.

Figure 5A:
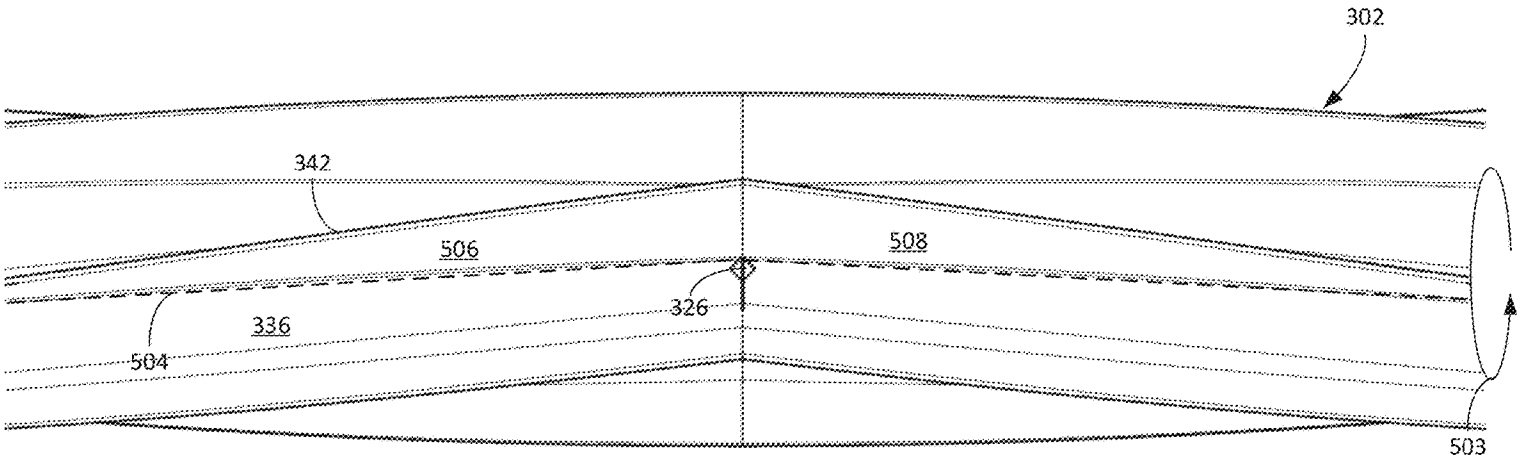
FIG. 5A is a zoomed in view of an inset 5A marked in FIG. 3C depicting a central portion of the cleaning roller of FIG. 3C.
Figure 5B:
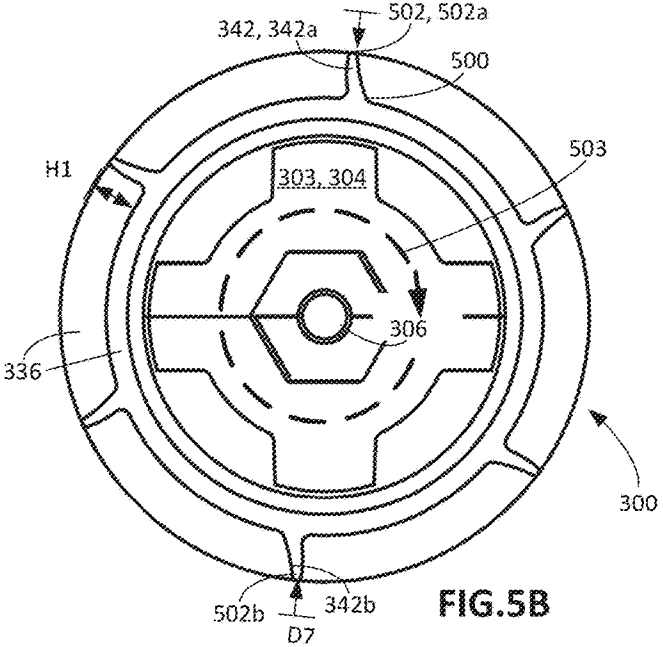
FIG. 5B is a cross-sectional view of an end portion of the cleaning roller of FIG. 3C taken along section 5B-5B shown in FIG. 3C.
Figure 5C:
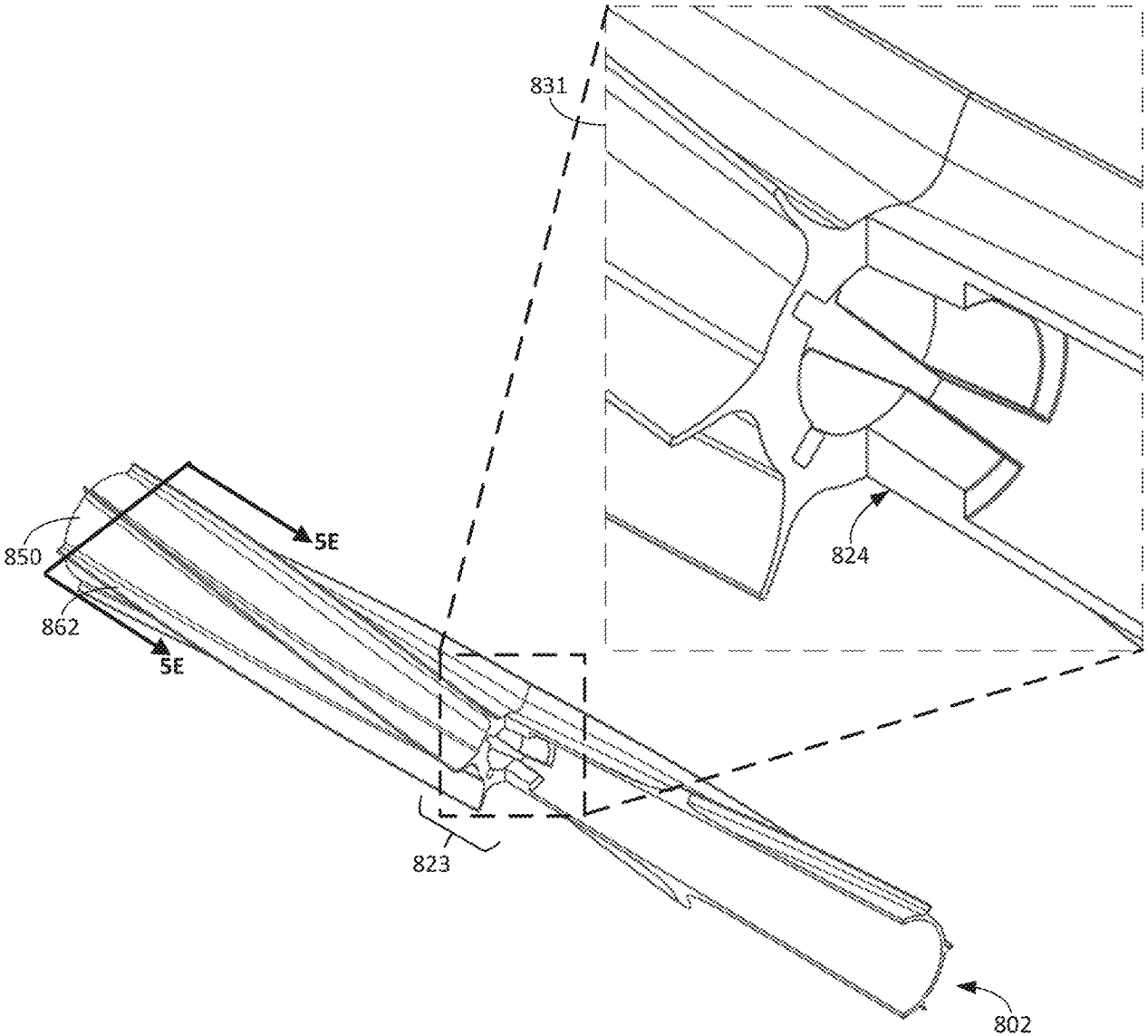
FIG. 5C is a partial cutaway view of a sheath of the cleaning roller of FIG. 3F.
Figure 5D:
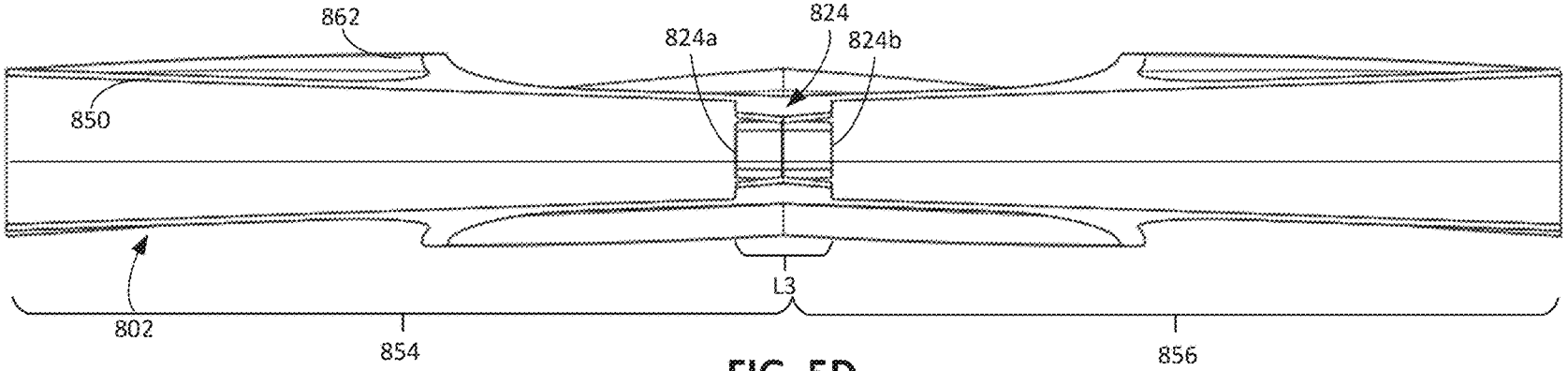
FIG. 5D is a front cutaway view of the sheath of the cleaning roller of FIG. 3F.

FIGS. 5A and 5B depict one example of the sheath 302 including one or more vanes on an outer surface of the shell 336. Referring to FIG. 3C, while a single vane 342 is described herein, the roller 300 includes multiple vanes in some implementations, with each of the multiple vanes being similar to the vane 342 but arranged at different locations along the outer surface of the shell 336. The vane 342 is a deflectable portion of the sheath 302 that, in some cases, engages with the floor surface 10 when the roller 300 is rotated during a cleaning operation. The vane 342 extends along outer surface of the cylindrical portions of the shell 336. The vane 342 extends radially outwardly from the sheath 302 and away from the longitudinal axis 312 of the roller 300. The vane 342 deflects when it contacts the floor surface 300 as the roller 300 rotates.

Referring to FIG. 5B, the vane 342 extends from a first end 500 fixed to the shell 336 and a second free end 502. A height of the vane 342 corresponds to, for example, a height H1 measured from the first end 500 to the second end 502, e.g., a height of the vane 342 measured from the outer surface of the shell 336. The height H1 of the vane 342 proximate the center 326 of the roller 300 is greater than the height H1 of the vane 342 proximate the first end portion 308 and the second portion 310 of the shaft 306. The height H1 of the vane 342 proximate the center of the roller 300 is, in some cases, a maximum height of the vane 342. In some cases, the height H1 of the vane 342 linearly decreases from the center 326 of the roller 300 toward the first end portion 308 of the shaft 306. In some cases, the height H1 of the vane 342 is uniform across the cylindrical portions of the shell 336. In some implementations, the vane 342 is angled rearwardly relative to a direction of rotation 503 of the roller 300 such that the vane 342 more readily deflects in response to contact with the floor surface 10.

Referring to FIG. 5A, the vane 342 follows, for example, a V-shaped path 504 along the outer surface of the shell 336. The V-shaped path 504 includes a first leg 506 and a second leg 508 that each extend from the central plane 327 toward the first end portion 318 and the second end portion 320 of the sheath 302, respectively. The first and second legs 506, 508 extend circumferentially along the outer surface of the shell 336, in particular, in the direction of rotation 503 of the roller 300. The height H1 of the vane 342 decreases along the first leg 506 of the path 504 from the central plane 327 toward the first end portion 318, and the height H1 of the vane 342 decreases along the second leg 508 of the path 504 from the central plane 327 toward the second end portion 320. In some cases, the height of the vanes 342 decreases linearly from the central plane 327 toward the second portion 320 and decreases linearly from the central plane 327 toward the first end portion 318.

In some cases, an outer diameter D7 of the sheath 302 corresponds to a distance between free ends 502*a*, 502*b* of vanes 342*a*, 342*b* arranged on opposite sides of a plane through the longitudinal axis 312 of the roller 300. The outer diameter D7 of the sheath 302 is uniform across the entire length of the sheath 302.

When the roller 300 is paired with another roller, e.g., the forward cleaning roller 105, the outer surface of the shell 336 of the roller 300 and the outer surface of the shell 336 of the other roller defines a separation therebetween, e.g., the separation 108 described herein. The rollers define an air gap therebetween, e.g., the air gap 109 described herein.

The width of the air gap between the rearward roller 104 and the forward roller 105 depends on whether the vanes 342*a*, 342 of the roller 300 faces the vanes of the other roller. While the width of the air gap between the sheath 302 of the roller 300 and the sheath between the other roller varies along the longitudinal axis 312 of the roller 300, the outer circumferences of the rollers are consistent. The forward roller 105 includes a conical sheath as described in relation to FIGS. 3*f*-3H, and so the air gap between the cleaning rollers varies (though the diameter of the sheath of the rear roller 104 remains constant). As described with respect to the roller 300, the free ends 502*a*, 502*b* of the vanes 342*a*, 342*b* define the outer circumference of the roller 300. Similarly, free ends of the vanes of the other roller define the outer circumference of the other roller. If the vanes 342*a*, 342*b* face the vanes of the other roller, the width of the air gap corresponds to a minimum width between the roller 300 and the other roller, e.g., a distance between the outer circumference of the shell 336 of the roller 300 and the outer circumference of the shell of the other roller. If the vanes 342*a*, 342*b* of the roller and the vanes of the other roller are positioned such that the air gap is defined by the distance between the shells of the rollers, the width of the air gap corresponds to a maximum width between the rollers, e.g., between the free ends 502*a*, 502*b* of the vanes 342*a*, 342*b* of the roller 300 and the free ends of the vanes of the other roller.

Example Cleaning Rollers: Front Roller Sheath

Referring to the inset 830*a* shown in FIG. 4E, a locking member 832 on the core 806 is positioned in the central portion 820 of the core 806. The locking member 832 extends radially outward from the shaft portion 814. The locking member 832 abuts the sheath 802, e.g., abuts the locking members 824 of the sheath 802, to inhibit movement of the sheath 802 relative to the core 806 in the second direction 812*b* along the longitudinal axis 812. The locking member 832 extends radially outward from the shaft portion 814 of the core 806. In some implementations, the locking member 832 is a continuous ring of material positioned around the shaft portion 814.

Locking members 834 positioned in the central portion 820 of the core 806 extend radially outward from the shaft portion 814. The locking members 834 abut the sheath 802, e.g., abuts the locking members 824 of the sheath 802, to inhibit movement of the sheath 802 in the first direction 812*a* along the longitudinal axis 812 relative to the core 806, the first direction 812*a* being opposite the second direction 812*b* in which movement of the sheath 802 is inhibited by the locking member 832. As shown in the inset 830*a* in FIG. 4E, the locking members 834 each includes an abutment surface 834*a* that contacts a different one of the locking members 824 of the sheath 802. The abutment surface 834*a* faces the second end portion 810 of the core 806. The locking members 834 also each includes a sloped surface 834*b*, e.g., sloped toward the center 825 of the roller 800. The sloped surface 834*b* faces the first end portion 808 of the core 806. The sloped surface 834*b* can improve manufacturability of the roller 800 by enabling the sheath 802 and, in particular, the locking members 824 of the sheath 802, to be easily slid over the locking members 834 and then into contact with the locking member 832 during assembly of the roller 800.

The locking member 832 and the locking members 834 cooperate to define the longitudinal position of the sheath 802 over the core 806. When the sheath 802 is positioned over the core 806, the abutment surfaces 834*a* of the locking members 834 contact first longitudinal ends 824*a*, and the locking member 832 contacts second longitudinal ends 824*b* (shown in FIG. 5D) of the locking members 824 of the sheath 802 (shown in FIG. 5D).

The features that maintain the relative positions of the support members 826*a*, 826*b* and the core 806 along the longitudinal axis 812 include one or more locking members that abut the support members 826*a*, 826*b* to inhibit movement of the support members 826*a*, 826*b* in the first direction 812*a* along the longitudinal axis 812, and one or more locking members that abut the support members 826*a*, 826*b* to inhibit movement of the support members 826*a*, 826*b* in the second direction 812*b* along the longitudinal axis 812. Referring to the inset 830*b* shown in FIG. 4E, locking members 836 (only one shown in FIG. 4E) on the core 806 extend radially outward from the shaft portion 814. The locking members 836 abut the support member 826*a* to inhibit movement of the support member 826*a* relative to the core 806 in the second direction 812*b*. In particular, abutment surfaces 836*a* of the locking members 836 abut the support member 826*a* to inhibit movement of the support member 826*a* in the second direction 812*b*. The abutment surfaces 836*a* face the first end portion 808 of the core 806.

Sloped surfaces 836*b* of the locking members 836, e.g., sloped toward the center 825 of the roller 800, enable the support member 826*a* to easily slide over the locking members 836 to position the support member 826*a* between the locking members 836 and a locking member 838. The sloped surfaces 836*b* face the second end portion 810 of the core 806. In this regard, during assembly, the support member 826*a* is slid over the second end portion 810 of the core 806, past the sloped surfaces 836*b*, and into the region between the locking members 836 and the locking member 838.

The locking member 838 on the core 806 extends radially outward from the shaft portion 814. The locking member 838 abuts the support member 826*a* to inhibit movement of the support member 826*a* relative to the core 806 in the second direction 812*b*. In some implementations, the locking member 838 is a continuous ring of material positioned around the shaft portion 814.

The locking members 836 and the locking member 838 cooperate to define the longitudinal position of the support member 826*a* over the core 806. When the support member 826*a* is positioned over the core 806, the locking member 832 contacts first longitudinal ends of the support member 826*a*, and the abutment surfaces 834*a* of the locking members 834 contact second opposite longitudinal ends of the support member 826*a*.

Referring to the inset 830*c* shown in FIG. 4E, locking members 840 and locking members 842 on the core 806 abut the support member 826*b* to inhibit movement of the support member 826*a* relative to the core 806 in the second direction 812*b* and the first direction 812*a*, respectively. The locking members 840, their abutment surfaces 840*a*, and their sloped surfaces 840*b* are similar to the locking members 836, their abutment surfaces 836*a*, and their sloped surfaces 836*b* to enable the support member 826*b* to be easily slid over the locking members 840 and into abutment with the locking member 842. The abutment surfaces 840*a* differ from the abutment surfaces 836*a* in that the abutment surfaces 840*a* face the second end portion 810 of the core 806, and the sloped surfaces 840*b* differ from the sloped surfaces 836*b* in that the sloped surfaces 840*b* face the first end portion 808 of the core 806. In this regard, the support member 826*b* is slid over the first end portion 808 of the core 806 to position the support member 826*b* in the region between the locking members 840 and the locking members 842.

In some implementations, the locking members 842 differs from the locking member 838 in that the locking members 842, rather than being formed from a continuous ring of material protruding from the shaft portion 814, are distinct protrusions extending from the shaft portion 814. The circumferential spacing between the locking members 842 and the locking members 840 enables the sheath 802 with its locking members 824 to be easily slid past the locking members 840, 842 in the first direction 812*a* during assembly of the roller 800.

The locking members 832, 834, 836, 838, 840, 842 are each positioned around the shaft portion 814 and can each be integrally molded to the core 806 such that the shaft portion 814 and the locking members 832, 834, 836, 838, 840, 842 form a single component, e.g., a single plastic component. For positioning the sheath 802 and the support members 826*a*, 826*b* over the core 806, the locking members 832, 834, 836, 838, 840, 842 can have similar diameters D4 shown in FIG. 4F. In some implementations, the outer diameter D4 is between 10 and 20 mm, e.g., between 10 mm and 15 mm, 12.5 mm and 17.5 mm, between 15 mm and 20 mm. For example, the outer diameter D4 is equal to the outer diameters D2 of the locking members 822 on the core 806. The outer diameter D4 is 1 to 5 mm greater than the diameter D1 of the shaft 814, e.g., 1 to 3 mm, 2 to 4 mm, or 3 to 5 mm greater than the diameter D1 of the shaft 814.

While the support structure 804 supports the sheath 802 and is interlocked with the sheath 802 at one or more portions of the sheath 802, the sheath 802 is radially unsupported and circumferentially unsupported along some portions of the sheath 802. Referring back to FIG. 3D, the support members 826*a*, 826*b* and the central portion 820 of the core 806 form a support system that radially support the sheath 802 at three distinct portions 844*a*, 844*b*, 844*c*. The inner surface of the sheath 802 is directly radially or transversally supported at the supported portions 844*a*, 844*b*, 844*c*. For example, the supported portion 844*a* and the support member 826*a* form a cylindrical joint in which relative sliding along the longitudinal axis 812 and relative rotation about the longitudinal axis 812 are allowed while other modes of motion are inhibited. The supported portion 844*c* and the support member 826*b* also form a cylindrical joint. Relative motion along or about the longitudinal axis 812 is accompanied with friction between the supported portions 844*a*, 844*b* and the support members 826*a*, 826*b*. The supported portion 844*b* and the central portion 820 of the core 806 form a rigid joint in which relative translation and relative rotation between the supported portion 844*b* and the central portion 820 are inhibited.

The sheath 802 is unsupported at portions 846*a*, 846*b*, 846*c*, 846*d*. The unsupported portion 846*a* corresponds to the portion of the sheath 802 between a first end portion 848*a* of the sheath 802 and the supported portion 844*a*, e.g., between the first end portion 848*a* of the sheath 802 and the support member 826*a*. The unsupported portion 846*b* corresponds to the portion of the sheath 802 between the supported portion 844*a* and the supported portion 844*b*, e.g., between the support member 826*a* and the center 825 of the roller 800. The unsupported portion 846*c* corresponds to the portion of the sheath 802 between the supported portion 844*b* and the supported portion 844*c*, e.g., between the center 825 of the roller 800 and the support member 826*b*. The unsupported portion 846*d* corresponds to the portion of the sheath 802 between the supported portion 844*b* and a second end portion 848*b* of the sheath 802, e.g., between the support member 826*b* and the second end portion 848*b* of the sheath 802.

The unsupported portions 846*b*, 846*c* overlie internal air gaps 852*a*, 852*b* defined by the sheath 802 and the support structure 804. The air gap 852*a* of the roller 800 corresponds to a space between the outer surface of the core 806, the support member 826*a*, and the inner surface of the sheath 802. The air gap 852*b* corresponds to a space between the outer surface of the core 806, the support member 826*b*, and the inner surface of the sheath 802. The air gaps 852*a*, 852*b* extend longitudinally along entire lengths of the unsupported portions 846*b*, 846*c* from the central portion 820 of the core 806 to the support members 826*a*, 826*b*. The air gaps 852*a*, 852*b* separate the support structure 804 from the sheath 802 along the unsupported portions 846*b*, 846*c*. These air gaps 852*a*, 852*b* enable the sheath 802 to deform inwardly toward the longitudinal axis 812 into the air gaps 852*a*, 852*b*, e.g., due to contact with debris on the floor surface during a cleaning operation.

The supported portions 844*a*, 844*b*, 844*c* deform relatively less than the unsupported portions 846*a*, 846*b*, 846*c*, 846*d* when the sheath 802 of the roller 800 contacts objects, such as the floor surface 10 and debris on the floor surface 10. In some cases, the unsupported portions 846*a*, 846*b*,

846*c*, 846*d* of the sheath 802 deflect in response to contact with the floor surface 10, while the supported portions 844*a*, 844*b*, 844*c* are radially compressed with little inward deflection compared to the inward deflection of the unsupported portions 846*a*, 846*b*, 846*c*, 846*d*. The amount of radial compression of the supported portions 844*a*, 844*b*, 844*c* is less than the amount of radial deflection of the unsupported portions 846*a*, 846*b*, 846*c*, 846*d* because the supported portions 844*a*, 844*b*, 844*c* are supported by material that extends radially toward the shaft portion 814, e.g., supported by the support members 826*a*, 826*b* and the central portion 820 of the core 806.

The unsupported portions 846*a*, 846*d* have lengths L5 between 15 and 25 mm, e.g., between 15 mm and 20 mm, 17.5 mm and 22.5 mm, or 20 mm and 25 mm. Each of the lengths L5 is 5% to 25% of the length L1 of the roller 800, e.g., between 5% and 15%, 10% and 20%, or 15% and 25% of the length L1 of the roller 800.

In some implementations, the sheath 802 contacts the core 806 only at the center 825 of the roller 800. Lengths L6, L7 corresponds to lengths of the air gaps 852*a*, 852*b*, e.g., the distance between the center 825 of the roller 800 and either of the support members 826*a*, 826*b*, the distance between the first longitudinal ends 824*a* of the locking member 824 and the first support member 826*a*, or the distance between the second longitudinal ends 824*b* of the locking member and the second support member 826*b*. The lengths L6, L7 are between 80 mm and 100 mm, e.g., between 80 mm and 90 mm, 85 mm and 95 mm, or 90 mm and 100 mm. For example, the lengths L6, L7 are equal to the distances L4 between either of the support members 826*a*, 826*b* and the center 825. Each of the lengths L6, L7 is between 25% and 45% of the length L1 of the roller 800, e.g., between 25% and 35%, 30% and 40%, or 35% and 45% of the length L1 of the roller 800. Each of the lengths L6, L7 is at least 25% of the length L1 of the roller 800, e.g., at least 30%, at least 35%, at least 40% or at least 45% of the length L1 of the roller 800. The combined value of the lengths L6, L7 is at least 50% of the length L1 of the roller 800, e.g., at least 60%, at least 70%, at least 80%, or at least 90% of the length L1 of the roller 800. In some implementations, the sheath 802 contacts the core 806 only at a point, e.g., at the center 825 of the roller 800, while in other implementations, the sheath 802 and the core 806 contact one another along a line extending along 25% to 100% of a length of the central portion 820 of the core 806.

As described herein, in addition to providing radial support to the sheath 802, the core 806 also provides circumferential support, in particular, by circumferentially abutting the sheath 802 with the central portion 820. For example, the circumferential support provided by the central portion 820 enables rotation of the core 806 to cause rotation of the sheath 802. In addition, when a torsional force is applied to the sheath 802 due to contact with an object, the sheath 802 substantially does not rotate relative to the core 806 at the central portion 820 of the core 806 because the sheath 802 is rotationally fixed to the core 806 at the central portion 820. In some implementations, the only location that the sheath 802 is rotationally supported is at the supported portion 844*b* of the sheath 802. In this regard, other portions of the sheath 802 can rotationally deform relative to the supported portion 844*b* and thereby rotate relative to the core 806.

In some implementations, the support members 826*a*, 826*b* provide circumferential support by generating a frictional reaction force between the support members 826*a*, 826*b* and the sheath 802. When a torque is applied to the core 806 and hence the support members 826*a*, 826*b* rotationally coupled to the core 806, a portion of the torque may transfer to the sheath 802. Similarly, when a torque is applied to the sheath 802, a portion of the torque may transfer to the core 806. However, during a cleaning operation, the sheath 802 will generally experience torques due to contact between the sheath 802 and an object that will be sufficiently great to cause relative rotation between portions of the sheath 802 and the support members 826*a*, 826*b*, e.g., between the support members 826*a*, 826*b* and portions of the sheath 802 overlying the support members 826*a*, 826*b*. This allowed relative rotation can improve debris pickup by the sheath 802.

The sheath 802 extends beyond the core 804 of the support structure 803 along the longitudinal axis 812 of the roller 800, in particular, beyond the first end portion 808 and the second end portion 810 of the core 806. The shell 850 of the sheath 802 includes a first half 854 and a second half 856. The first half 854 corresponds to the portion of the shell 850 on one side of a central plane 827 passing through the center 825 of the roller 800 and perpendicular to the longitudinal axis 812 of the roller 800. The second half 856 corresponds to the other portion of the shell 850 on the other side of a central plane 827. The central plane 827 is, for example, a bisecting plane that divides the roller 800 into two symmetric halves. The shell 850 has a wall thickness between 0.5 mm and 3 mm, e.g., 0.5 mm to 1.5 mm, 1 mm to 2 mm, 1.5 mm to 2.5 mm, or 2 mm to 3 mm.

Referring to FIG. 3H, the roller 800 includes a first collection well 858 and a second collection well 860. The collection wells 858, 860 correspond to volumes on ends of the roller 800 where filament debris engaged by the roller 800 tend to collect. In particular, as the roller 800 engages filament debris on the floor surface 10 during a cleaning operation, the filament debris moves over the end portions 848*a*, 848*b* of the sheath 802, wraps around the core 806, and then collects within the collection wells 858, 860. The filament debris wraps around the first and second end portions 808, 810 of the core 806 and can be easily removed from the elongate the first and second end portions 808, 810 by the user. In this regard, the first and second end portions 808, 810 are positioned within the collection wells 858, 860. The collection wells 858, 860 are defined by the sheath 802 and the support members 826*a*, 826*b*. The collection wells 858, 860 are defined by the unsupported portions 846*a*, 846*d* of the sheath 802 that extend beyond the support members 826*a*, 826*b*.

The first collection well 858 is positioned within the first half 854 of the shell 850. The first collection well 858 is, for example, defined by the support member 826*a*, the unsupported portion 846*a* of the sheath 802, and the portion of the core 806 extending through the unsupported portion 846*a* of the sheath 802. The length L5 of the unsupported portion 846*a* of the sheath 802 defines the length of the first collection well 858.

The second collection well 860 is positioned within the second half 856 of the shell 850. The second collection well 860 is, for example, defined by the support member 826*b*, the unsupported portion 846*b* of the sheath 802, and the portion of the core 806 extending through the unsupported portion 846*b* of the sheath 802. The length L5 of the unsupported portion 846*d* of the sheath 802 defines the length of the second collection well 860.

The sheath 802 extends to the edges of the cleaning head 100 to maximize the coverage of the cleaning head on the cleaning surface 10. The sheath 802 extends across a lateral axis of the bottom of the cleaning robot 102 within 5% of a side edge of the bottom of the cleaning robot 102. In some implementations, the sheath 802 extends more than 90% across the lateral length of the cleaning head 100. In some implementations, the sheath 802 extends within 1 cm of the side edge of the bottom of the robot 102. In some implementations, the sheath 802 extends within 1-5 cm, 2-5 cm, or between 3-5 cm from the side edge of the bottom of the robot.

Figure 5E:
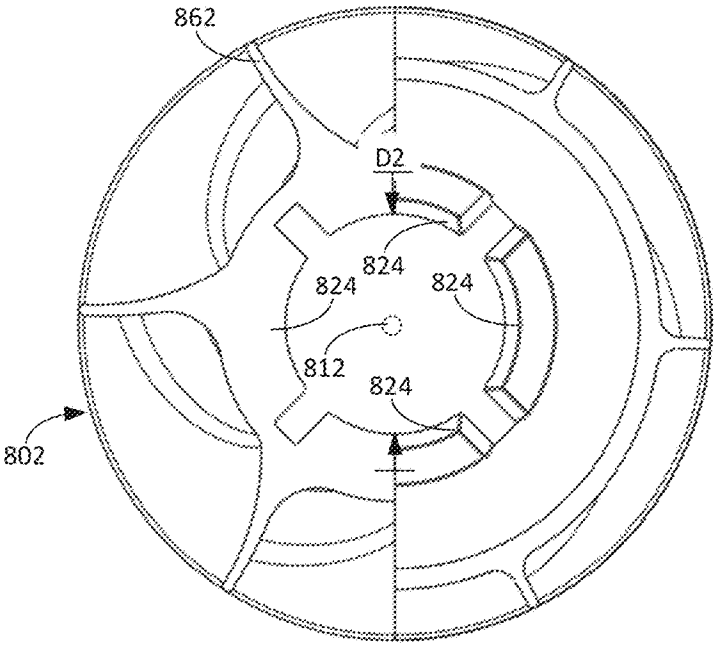
FIG. 5E is a stitched image of a cross-sectional side view of the sheath of FIG. 5C along section 5E-5E.

Referring to FIG. 5E, in some implementations, the sheath 802 of the roller 800 is a monolithic component including the shell 850 and cantilevered vanes extending substantially radially from the outer surface of the shell 850. Each vane has one end fixed to the outer surface of the shell 850 and another end that is free. The height of each vane is defined as the distance from the fixed end at the shell 850, e.g., the point of attachment to the shell 850, to the free end. The free end sweeps an outer circumference of the sheath 802 during rotation of the roller 800. The outer circumference is consistent along the length of the roller 800. Because the radius from the longitudinal axis 812 to the outer surface of the shell 850 decreases from the end portions 848*a*, 848*b* of the sheath 802 to the center 825, the height of each vane increases from the end portions 848*a*, 848*b* of the sheath 802 to the center 825 so that the outer circumference of the roller 800 is consistent across the length of the roller 800. In some implementations, the vanes are chevron shaped such that each of the two legs of each vane starts at opposing end portions 848*a*, 848*b* of the sheath 802, and the two legs meet at an angle at the center 825 of the roller 800 to form a "V" shape. The tip of the V precedes the legs in the direction of rotation.

FIG. 5E depicts one example of the sheath 802 including one or more vanes on an outer surface of the shell 850. While a single vane 862 is described herein, the roller 800 includes multiple vanes in some implementations, with each of the multiple vanes being similar to the vane 862 but arranged at different locations along the outer surface of the shell 850. For example, the sheath 802 includes 4 to 12 vanes, e.g., 4 to 8 vanes, 6 to 10 vanes, or 8 to 12 vanes. The vane 862 is a deflectable portion of the sheath 802 that, in some cases, engages with the floor surface 10 when the roller 800 is rotated during a cleaning operation. The vane 862 extends along outer surfaces of the first half 854 and the second half 856 of the shell 850. The vane 862 extends radially outwardly from the sheath 802 and away from the longitudinal axis 812 of the roller 800. The vane 862 deflects when it contacts the floor surface 10 as the roller 800 rotates.

Figure 5F:
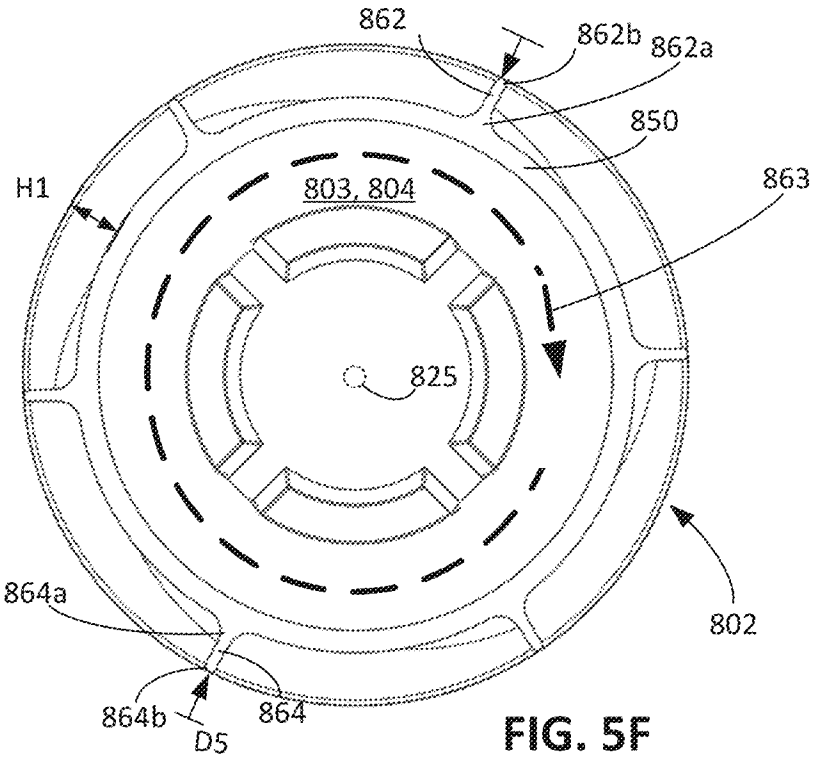
FIG. 5F is a side view of the sheath of FIG. 5A.

Referring to FIG. 5F, the vane 862 extends from a first end 862*a* fixed to the shell 850 and a second free end 862*b*. A height of the vane 862 corresponds to, for example, a height H1 measured from the first end 862*a* to the second end 862*b*, e.g., a height of the vane 862 measured from the outer surface of the shell 850. The height H1 of the vane 862 proximate the center 825 of the roller 800 is greater than the height H1 of the vane 862 proximate the first end portion 848*a* and the second portion 848*b* of the sheath 802. The height H1 of the vane 862 proximate the center of the roller 800 is, in some cases, a maximum height of the vane 862. In some cases, the height H1 of the vane 862 linearly decreases from the center 825 of the roller 800 toward the first end portion 848*a* of the sheath 802 and toward the second end portion 848*b* of the sheath 802. In some implementations, the vane 862 is angled rearwardly relative to a direction of rotation 863 of the roller 800 such that the vane 862 more readily deflects in response to contact with the floor surface 10.

Referring to FIG. 5F, the height H1 of the vane 862 is, for example, between 0.5 mm and 25 mm, e.g., between 0.5 and 2 mm, 5 and 15 mm, 5 and 20 mm, 5 and 25 mm, etc. The height H1 of the vane 862 at the central plane 827 is between, for example, 2.5 and 25 mm, e.g., between 2.5 and 12.5 mm, 7.5 and 17.5 mm, 12.5 and 25 mm, etc. The height H1 of the vane 862 at the end portions 848*a*, 848*b* of the sheath 802 is between, for example, 0.5 and 5 mm, e.g., between 0.5 and 1.5 mm, 0.5 and 2.5 mm, etc. The height H1 of the vane 862 at the central plane 827 is, for example, 1.5 to 50 times greater than the height H1 of the vane 862 at the end portions 848*a*, 848*b* of the sheath 802, e.g., 1.5 to 5, 5 to 10, 10 to 20, 10 to 50, etc., times greater than the height H1 of the vane 862 at the end portions 848*a*, 848*b* of the sheath 802. The height H1 of the vane 862 at the central plane 827, for example, corresponds to the maximum height of the vane 862, and the height H1 of the vane 862 at the end portions 848*a*, 848*b* of the sheath 802 corresponds to the minimum height of the vane 862. In some implementations, the maximum height of the vane 862 is 5% to 45% of the diameter D5 of the sheath 802, e.g., 5% to 15%, 15% to 30%, 30% to 45%, etc., of the diameter D5 of the sheath 802.

Referring to FIG. 3H, the shell 850 of the sheath 802 tapers along the longitudinal axis 812 of the roller 800 toward the center 825, e.g., toward the central plane 827. Both the first half 854 and the second half 856 of the shell 850 taper along the longitudinal axis 812 toward the center 825, e.g., toward the central plane 827, over at least a portion of the first half 854 and the second half 856, respectively. In some implementations, the first half 854 tapers from the first outer end portion 848*a* to the center 825, and the second half 856 tapers from the second outer end portion 848*b* to the center 825. In some implementations, rather than tapering toward the center 825 along an entire length of the sheath 802, the shell 850 of the sheath 802 tapers toward the center 825 along the unsupported portions 846*b*, 846*c* and does not taper toward the center 825 along the unsupported portions 846*a*, 846*d*.

In this regard, the first half 854 and the second half 856 are frustoconically shaped. Central axes of the frustocones formed by the first half 854, the second half 856 each extends parallel to and through the longitudinal axis 812 of the roller 800. Accordingly, the inner surfaces defined by the unsupported portions 846*a*, 846*b*, 846*c*, 846*d* are each frustoconically shaped and tapered toward the center 825 of the roller 800. Furthermore, the air gaps 852*a*, 852*b* are frustoconically shaped and tapered toward the center 825 of the roller 800.

An outer diameter D6 of the shell 850 at the central plane 827 is, for example, less than outer diameters D7, D8 of the shell 850 at the outer end portions 848*a*, 848*b* of the sheath 802. In some cases, the outer diameter of the shell 850 linearly decreases toward the center 825.

The diameter of the shell 850 of the sheath 802 may vary at different points along the length of the shell 850. The diameter D6 of the shell 850 along the central plane 827 is between, for example, 7 mm and 22 mm, e.g., between 7 and 17 mm, 12 and 22 mm, etc. The diameter D6 of the shell 850 along the central plane 827 is, for example, defined by the distance between outer surfaces of the shell 850 along the central plane 827. The diameters D7, D8 of the shell 850 at the outer end portions 848*a*, 848*b* of the sheath 802 are, for example, between 15 mm and 55 mm, e.g., between 15 and 40 mm, 20 and 45 mm, 30 mm and 55 mm, etc.

The diameter D6 of the shell 850 is, for example, between 10% and 50% of the diameter D8 of the sheath 802, e.g., between 10% and 20%, 15% and 25%, 30% and 50%, etc., of the diameter D8. The diameters D6, D7 of the shell 850 is, for example, between 80% and 95% of the diameter D8 of the sheath 802, e.g., between 80% and 90%, 85% and 95%, 90% and 95%, etc., of the diameter D8 of the sheath 802.

In some implementations, the diameter D6 corresponds to the minimum diameter of the shell 850 along the length of the shell 850, and the diameters D7, D8 correspond to the maximum diameter of the shell 850 along the length of the shell 850. In the example depicted in FIG. 1B, the length S2 of the separation 108 is defined by the maximum diameters of the shells of the cleaning rollers 104, 105. The length S3 of the separation 108 is defined by the minimum diameters of the shells of the cleaning rollers 104, 105.

The diameter of the shell 850 also varies linearly along the length of the shell 850 in some examples. From the minimum diameter to the maximum diameter along the length of the shell 850, the diameter of the shell 850 increases with a slope M1. The slope M1 is between, for example, 0.01 to 0.4 mm/mm, e.g., between 0.01 to 0.3 mm/mm, 0.05 mm to 0.35 mm/mm, etc. The angle between the slope M1 and the longitudinal axis 812 is between, for example, 0.5 degrees and 20 degrees, e.g., between 1 and 10 degrees, 5 and 20 degrees, 5 and 15 degrees, 10 and 20 degrees, etc. In particular, the slope M1 corresponds to the slope of the frustocones defined by the first and second halves 854, 856 of the shell 850.

When the roller 800 is paired with another roller, e.g., the rear cleaning roller 300, the outer surface of the shell 850 of the roller 800 and the outer surface of the shell 850 of the other roller defines a separation therebetween, e.g., the separation 108 described herein. The rollers define an air opening therebetween, e.g., the air opening 109 described herein. Because of the taper of the first and second halves 854, 856 of the shell 850, the separation increases in size toward the center 825 of the roller 800. The frustoconical shape of the halves 854, 856 facilitate movement of filament debris picked up by the roller 800 toward the end portions 848*a*, 848*b* of the sheath 802. The filament debris can then be collected into the collection wells 858, 860 such that a user can easily remove the filament debris from the roller 800. In some examples, the user dismounts the roller 800 from the robot to enable the filament debris collected within the collection wells 858, 860 to be removed.

In some cases, the air opening varies in size because of the taper of the first and second halves 854, 856 of the shell 850. In particular, the width of the air opening depends on whether the vanes 862, 864 of the roller 800 face the vanes of the other roller. While the width of the air opening between the sheath 802 of the roller 800 and the sheath of the other roller varies along the longitudinal axis 812 of the roller 800, the outer circumferences of the rollers are consistent. As described with respect to the roller 800, the free ends 862*b*, 864*b* of the vanes 862, 864 define the outer circumference of the roller 800. Similarly, free ends of the vanes of the other roller define the outer circumference of the other roller. If the vanes 862, 864 face the vanes of the other roller, the width of the air opening corresponds to a minimum width between the roller 800 and the other roller, e.g., a distance between the outer circumference of the shell 850 of the roller 800 and the outer circumference of the shell of the other roller. If the vanes 862, 864 of the roller and the vanes of the other roller are positioned such that the width of the air opening is defined by the distance between the shells of the rollers and corresponds to a maximum width between the rollers, e.g., between the free ends 862*b*, 862*b* of the vanes 862, 864 of the roller 800 and the free ends of the vanes of the other roller.

Example Dimensions of Cleaning Robots and Cleaning Rollers

Figure 6:
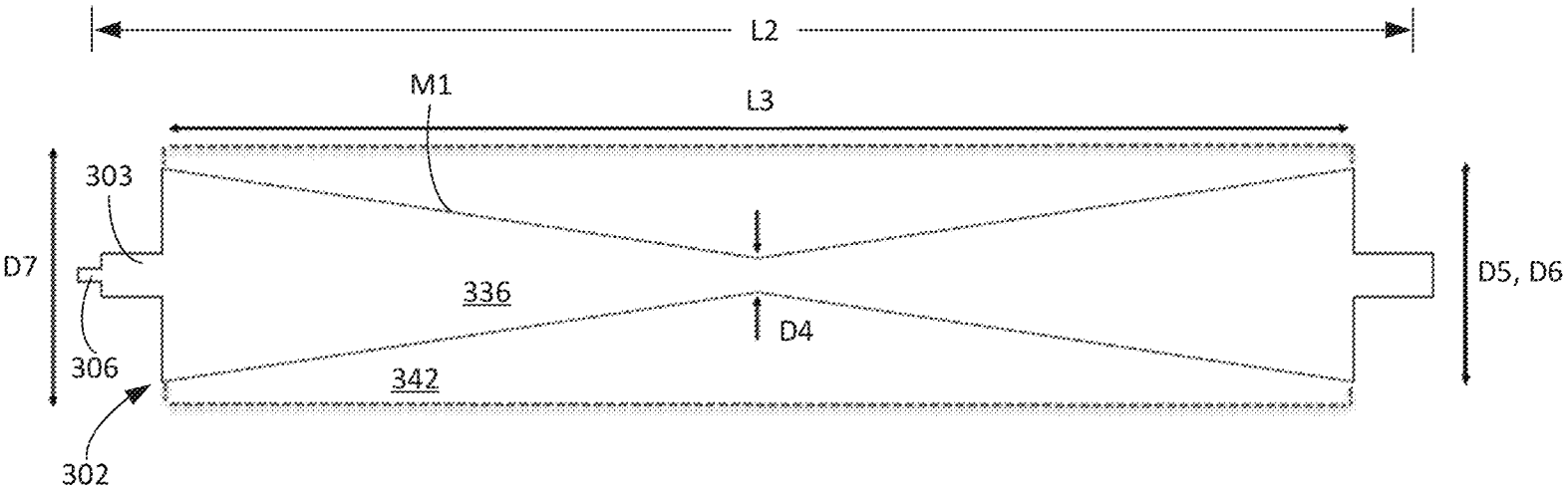
FIG. 6 is a schematic diagram of the cleaning rollers of FIG. 3A, 3F with free portions of a sheath of the cleaning roller removed.

Dimensions of the cleaning robot 102, the roller 300, and their components vary between implementations. Referring to FIG. 3E and FIG. 6, in some examples, the length L2 of the roller 300 corresponds to the length between the outer end portions 308, 310 of the shaft 306. In this regard, a length of the shaft 306 corresponds to the overall length L2 of the roller 300. The length L2 is between, for example, 10 cm and 50 cm, e.g., between 10 cm and 30 cm, 20 cm and 40 cm, 30 cm and 50 cm. The length L2 of the roller 300 is, for example, between 70% and 90% of an overall width W1 of the robot 102 (shown in FIG. 2A), e.g., between 70% and 80%, 75% and 85%, and 80% and 90%, etc., of the overall width W1 of the robot 102. The width W1 of the robot 102 is, for instance, between 20 cm and 60 cm, e.g., between 20 cm and 40 cm, 30 cm and 50 cm, 40 cm and 60 cm, etc.

Referring to FIG. 3E, the length L3 of the core 304 is between 8 cm and 40 cm, e.g., between 8 cm and 20 cm, 20 cm and 30 cm, 15 cm and 35 cm, 25 cm and 40 cm, etc. The length L3 of the core 304 corresponds to, for example, the length of the sheath 302. The length L3 of the core 304 is between 70% and 90% the length L2 of the roller 300, e.g., between 70% and 80%, 70% and 85%, 75% and 90%, etc., of the length L2 of the roller 300. A length L4 of the sheath 302 is between 9.5 cm and 47.5 cm, e.g., between 9.5 cm and 30 cm, 15 cm and 30 cm, 20 cm and 40 cm, 20 cm and 47.5 cm, etc. The length L4 of the sheath 302 is between 80% and 99% of the length L2 of the roller 300, e.g., between 85% and 99%, 90% and 99%, etc., of the length L2 of the roller 300.

Referring to FIG. 4B, a length L8 of one of the elongate portions 305*a*, 305*b* of the support structure 303 is, for example, between 1 cm and 5 cm, e.g., between 1 and 3 cm, 2 and 4 cm, 3 and 5 cm, etc. The elongate portions 305*a*, 306*b* have a combined length that is, for example, between 10 and 30% of an overall length L9 of the support structure 303, e.g., between 10% and 20%, 15% and 25%, 20% and 30%, etc., of the overall length L9. In some examples, the length of the elongate portion 305*a* differs from the length of the elongate portion 305*b*. The length of the elongate portion 305*a* is, for example, 50% to 90%, e.g., 50% to 70%, 70% to 90%, the length of the elongate portion 305*b*.

The length L3 of the core 304 is, for example, between 70% and 90% of the overall length L9, e.g., between 70% and 80%, 75% and 85%, 80% and 90%, etc., of the overall length L9. The overall length L9 is, for example, between 85% and 99% of the overall length L2 of the roller 300, e.g., between 90% and 99%, 95% and 99%, etc., of the overall length L2 of the roller 300. The shaft 306 extends beyond the elongate portion 305*a* by a length L10 of, for example, 0.3 mm to 2 mm, e.g., between 0.3 mm and 1 mm, 0.3 mm and 1.5 mm, etc. As described herein, in some cases, the overall length L2 of the roller 300 corresponds to the overall length of the shaft 306, which extends beyond the length L9 of the support structure 303.

In some implementations, as shown in FIG. 6, a width or diameter of the roller 300 between the end portion 318 and the end portion 320 of the sheath 302 corresponds to the diameter D7 of the sheath 302. The diameter D7 is, in some cases, uniform from the end portion 318 to the end portion 320 of the sheath 302. The diameter D7 of the roller 300 at different positions along the longitudinal axis 312 of the roller 300 between the position of the end portion 318 and the position of the end portion 320 is equal. The diameter D7 is between, for example, 20 mm and 60 mm, e.g., between 20 mm and 40 mm, 30 mm and 50 mm, 40 mm and 60 mm, etc.

Referring to FIG. 5B, the height H1 of the vane 342 is, for example, between 0.5 mm and 25 mm, e.g., between 0.5 and 2 mm, 5 and 15 mm, 5 and 20 mm, 5 and 25 mm, etc. The height H1 of the vane 342 at the central plane 327 is between, for example, 2.5 and 25 mm, e.g., between 2.5 and 12.5 mm, 7.5 and 17.5 mm, 12.5 and 25 mm, etc. The height H1 of the vane 342 at the end portions 318, 320 of the sheath 302 is between, for example, 0.5 and 5 mm, e.g., between 0.5 and 1.5 mm, 0.5 and 2.5 mm, etc. The height H1 of the vane 342 at the central plane 327 is, for example, 1.5 to 50 times greater than the height H1 of the vane 342 at the end portions 318, 320 of the sheath 302, e.g., 1.5 to 5, 5 to 10, 10 to 20, 10 to 50, etc., times greater than the height H1 of the vane 342 at the end portions 318, 320. The height H1 of the vane 342 at the central plane 327, for example, corresponds to the maximum height of the vane 342, and the height H1 of the vane 342 at the end portions 318, 320 of the sheath 302 corresponds to the minimum height of the vane 342. In some implementations, the maximum height of the vane 342 is 5% to 45% of the diameter D7 of the sheath 302, e.g., 5% to 15%, 15% to 30%, 30% to 45%, etc., of the diameter D7 of the sheath 302.

While the diameter D7 may be uniform between the end portions 318, 320 of the sheath 302, the diameter of the core 304 may vary at different points along the length of the roller 300. The diameter D1 of the core 304 along the central plane 327 is between, for example, 5 mm and 20 mm, e.g., between 5 and 10 mm, 10 and 15 mm, 15 and 20 mm etc. The diameters D2, D3 of the core 304 near or at the first and second end portions 314, 316 of the core 304 is between, for example, 10 mm and 50 mm, e.g., between 10 and 20 mm, 15 and 25 mm, 20 and 30 mm, 20 and 50 mm. The diameters D2, D3 are, for example the maximum diameters of the core 304, while the diameter D1 is the minimum diameter of the core 304. The diameters D2, D3 are, for example, 5 to 20 mm less than the diameter D7 of the sheath 302, e.g., 5 to 10 mm, 5 to 15 mm, 10 to 20 mm, etc., less than the diameter D7. In some implementations, the diameters D2, D3 are 10% to 90% of the diameter D7 of the sheath 302, e.g., 10% to 30%, 30% to 60%, 60% to 90%, etc., of the diameter D7 of the sheath 302. The diameter D1 is, for example, 10 to 25 mm less than the diameter D7 of the sheath 302, e.g., between 10 and 15 mm, 10 and 20 mm, 15 and 25 mm, etc., less than the diameter D7 of the sheath 302. In some implementations, the diameter D1 is 5% to 80% of the diameter D7 of the sheath 302, e.g., 5% to 30%, 30% to 55%, 55% to 80%, etc., of the diameter D7 of the sheath 302.

Similarly, while the outer diameter of the sheath 302 defined by the free ends 502*a*, 502*b* of the vanes 342*a*, 342*b* may be uniform, the diameter of the shell 336 of the sheath 302 may vary at different points along the length of the shell 336. The diameter D4 of the shell 336 along the central plane 327 is between, for example, 7 mm and 22 mm, e.g., between 7 and 17 mm, 12 and 22 mm, etc. The diameter D4 of the shell 336 along the central plane 327 is, for example, defined by a wall thickness of the shell 336. The diameters D5, D6 of the shell 336 at the outer end portions 318, 320 of the sheath 302 are, for example, between 15 mm and 55 mm, e.g., between 15 and 40 mm, 20 and 45 mm, 30 mm and 55 mm, etc. In some cases, the diameters D4, D5, and D6 are 1 to 5 mm greater than the diameters D1, D2, and D3 of the core 304 along the central plane 327, e.g., between 1 and 3 mm, 2 and 4 mm, 3 and 5 mm, etc., greater than the diameter Dl. The diameter D4 of the shell 336 is, for example, between 10% and 50% of the diameter D7 of the sheath 302, e.g., between 10% and 20%, 15% and 25%, 30% and 50%, etc., of the diameter D7. The diameters D5, D6 of the shell 336 is, for example, between 80% and 95% of the diameter D7 of the sheath 302, e.g., between 80% and 90%, 85% and 95%, 90% and 95%, etc., of the diameter D7 of the sheath 302.

In some implementations, the diameter D4 corresponds to the minimum diameter of the shell 336 along the length of the shell 336, and the diameters D5, D6 correspond to the maximum diameter of the shell 336 along the length of the shell 336. The diameters D5, D6 correspond to, for example, the diameters of the shell 336. In the example depicted in FIG. 1B, the length S2 of the separation 108 is defined by the maximum diameters of the shells of the cleaning rollers 104, 105. The length S3 of the separation S3 of the separation 108 is defined by the minimum diameters of the shells of the cleaning rollers 104, 105.

In some implementations, the diameter of the core 304 varies linearly along the length of the core 304. From the minimum diameter to the maximum diameter over the length of the core 304, the diameter of the core 304 increases with a slope M1 between, for example, 0.01 to 0.4 mm/mm, e.g., between 0.01 to 0.3 mm/mm, 0.05 mm to 0.35 mm/mm, etc. In this regard, the angle between the slope M1 defined by the outer surface of the core 304 and the longitudinal axis 312 is between, for example, 0.5 degrees and 20 degrees, e.g., between 1 and 10 degrees, 5 and 20 degrees, 5 and 15 degrees, 10 and 20 degrees, etc.

Figure 7B:
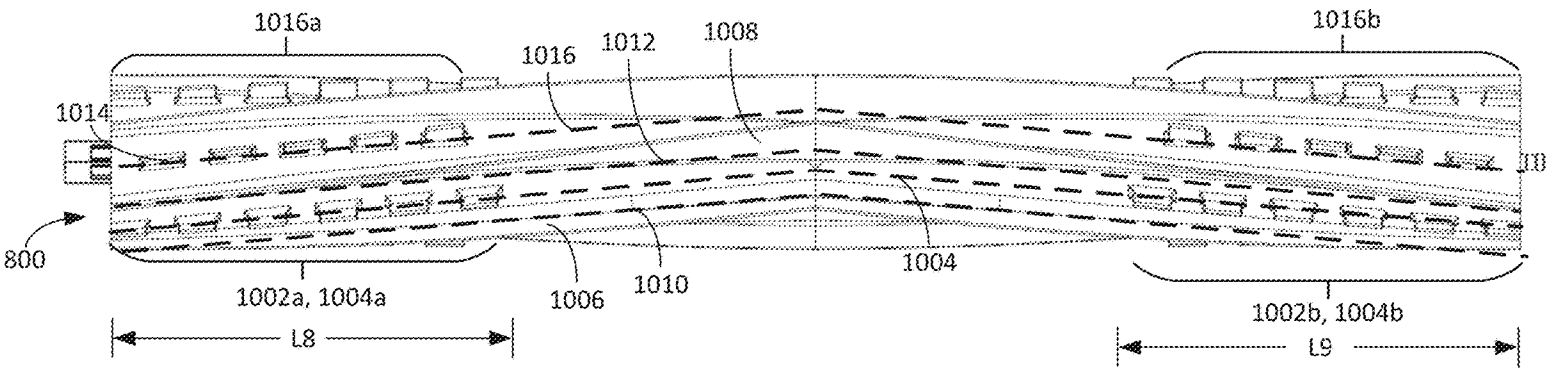

The sheath 302 is described as having vanes, e.g., the vanes 362, 364, extending along outer surfaces of the shell 350. In some implementations, as shown in FIGS. 7A and 7B, the sheath 302 further includes nubs 1000 extending radially outward from the outer surfaces of the shell 350. The nubs 1000 protrude radially outwardly from the outer surface of the shell 350 and are spaced apart from one another along the outer surface of the shell 350. The nubs 1000 extend across an entire length L1 of the roller 300. The lengths L8, L9 are each 50 mm to 90 mm, e.g., 50 to 70 mm, 60 to 80 mm, or 70 to 90 mm. The lengths L8, L9 are 10% to 40% of the length L1 of the roller 300, e.g., between 10% and 20%, between 15% and 25%, between 15% and 35%, between 20% and 30%, between 25% and 35%, or between 30% and 40% of the length L1 of the roller 300.

Figure 7C:
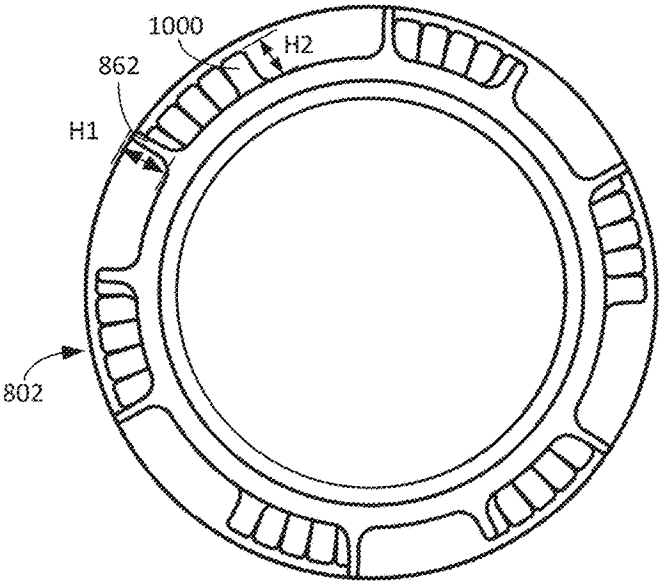

Turning to FIGS. 7B-7C, an example sheath 802 of the foreword roller 105 is shown. The first portion 1002*a* of the nubs 1000 extends along a portion 1004*a* of a path 1004 circumferentially offset from the path 366 for the vane 362, and the second portion 1002*b* of the nubs 1000 extends along a portion 1004*b* of the path 1004. The path 1004 is a V-shaped path, and the portions 1004*a*, 1004*b* corresponds to portions of legs of the path 1004. In this regard, the path 1004 extends both circumferentially and longitudinally along the outer surface of the shell 350. The nubs 1000 each has a length of 2 to 5 mm, e.g., 2 to 3 mm, 3 to 4 mm, or 4 to 5 mm. The spacing between adjacent nubs 1000 along the path 1004 has a length of 1 to 4 mm, e.g., 1 to 2 mm, 2 to 3 mm, or 3 to 4 mm.

As described herein, the height H1 of the vane 862 relative to the longitudinal axis 812 is uniform across a length of the roller 800. In some implementations, referring to FIG. 7C, heights H2 of the nubs 1000 relative to the shell 850 of the sheath 802 are uniform along the portions 1004*a*, 1004*b* of the path 1004. The height H1 of the vane 862 is 0.5 to 1.5 mm greater than the heights H2 of the nubs 1000, e.g., 0.5 to 1 mm, 0.75 to 1.25 mm, or 1 to 1.5 mm greater than the heights H2 of the nubs 1000.

In some implementations, paths for the vanes are positioned between adjacent paths for nubs, and paths for nubs are positioned between adjacent paths for vanes. In this regard, the paths for nubs and the paths for vanes are alternately arranged around the outer surface of the shell 850. For example, the first portion 1002*a* of the nubs 1000 and the second portion 1002*b* of nubs 1000 are positioned between a first vane 1006, e.g., the vane 862, and a second vane 1008. The nubs 1000 form a first set of nubs 1000 extending along the portions 1004*a*, 1004*b* of the path 1004, and the first and second vanes 1006, 1008 extend along V-shaped paths 1010, 1012, respectively. The path 1004 is positioned circumferentially between the paths 1010, 1012. Nubs 1014 forma second set of nubs 1014 that extends along portions 1016*a*, 1016*b* of a path 1016. The path 1010 for the first vane 1006 is positioned circumferentially between the paths 1004, 1016 for the first and second set of nubs 1000, 1014.

Example Fabrication Processes for Cleaning Rollers

The specific configurations of the sheath 302, the support structure 303, and the shaft 306 of the roller 300 can be fabricated using one of a number of appropriate processes. The shaft 306 is, for example, a monolithic component formed from a metal fabrication process, such as machining, metal injection molding, etc. To affix the support structure 303 to the shaft 306, the support structure 303 is formed from, for example, a plastic material in an injection molding process in which molten plastic material is injected into a mold for the support structure 303. In some implementations, in an insert injection molding process, the shaft 306 is inserted into the mold for the support structure 303 before the molten plastic material is injected into the mold. The molten plastic material, upon cooling, bonds with the shaft 306 and forms the support structure 303 within the mold. As a result, the support structure 303 is affixed to the shaft 306. If the core 304 of the support structure 303 includes the discontinuous sections 402*a*, 402*b*, 402*c*, 404*a*, 404*b*, 404*c*, the surfaces of the mold engages the shaft 306 at the gaps 403 between the discontinuous sections 402*a*, 402*b*, 402*c*, 404*a*, 404*b*, 404*c* to inhibit the support structure 303 from forming at the gaps 403.

In some cases, the sheath 302 is formed from an insert injection molding process in which the shaft 306 with the support structure 303 affixed to the shaft 306 is inserted into a mold for the sheath 302 before molten plastic material forming the sheath 302 is injected into the mold. The molten plastic material, upon cooling, bonds with the core 304 of the support structure 303 and forms the sheath 302 within the mold. By bonding with the core 304 during the injection molding process, the sheath 302 is affixed to the support structure 303 through the core 304. In some implementations, the mold for the sheath 302 is designed so that the sheath is bonded to the core 304. In some implementations, end portions of the sheath 302 are unattached and extend freely beyond the end portions 314, 316 of the core 304 to define the collection wells.

In some implementations, to improve bond strength between the sheath 302 and the core 304, the core 304 includes structural features that increase a bonding area between the sheath 302 and the core 304 when the molten plastic material for the sheath 302 cools. In some implementations, the lobes of the core 304, e.g., the lobes 414*a*-414*d*, 418*a*-418*d*, increase the bonding area between the sheath 302 and the core 304. The core securing portion 350 and the lobes of the core 304 have increased bonding area compared to other examples in which the core 304 has, for example, a uniform cylindrical or uniform prismatic shape. In a further example, the posts 420 extend into sheath 302, thereby further increasing the bonding area between the core securing portion 350 and the sheath 302. The posts 420 engage the sheath 302 to rotationally couple the sheath 302 to the core 304. In some implementations, the gaps 403 between the discontinuous sections 402*a*, 402*b*, 402*c*, 404*a*, 404*b*, 404*c* enable the plastic material forming the sheath 302 extend radially inwardly toward the shaft 306 such that a portion of the sheath 302 is positioned between the discontinuous sections 402*a*, 402*b*, 402*c*, 404*a*, 404*b*, 404*c* within the gaps 403. In some cases, the shaft securing portion 352 contacts the shaft 306 and is directly bonded to the shaft 306 during the insert molding process described herein.

This example fabrication process can further facilitate even torque transfer from the shaft 306, to the support structure 303, and to the sheath 302. The enhanced bonding between these structures can reduce the likelihood that torque does not get transferred from the drive axis, e.g., the longitudinal axis 312 of the roller 300 outward toward the outer surface of the sheath 302. Because torque is efficiently transferred to the outer surface, debris pickup can be enhanced because a greater portion of the outer surface of the roller 300 exerts a greater amount of torque to move debris on the floor surface.

Furthermore, because the sheath 302 extends inwardly toward the core 304 and interlocks with the core 304, the shell 336 of the sheath 302 can maintain a round shape in response to contact with the floor surface. While the vanes 342*a*, 342*b* can deflect in response to contact with the floor surface and/or contact with debris, the shell 336 can deflect relatively less, thereby enabling the shell 336 to apply a greater amount of force to debris that it contacts. This increased force applied to the debris can increase the amount of agitation of the debris such that the roller 300 can more easily ingest the debris. Furthermore, increased agitation of the debris can assist the airflow 120 generated by the vacuum assembly 118 to carry the debris into the cleaning robot 102. In this regard, rather than deflecting in response to contact with the floor surface, the roller 300 can retains its shape and more easily transfer force to the debris.

Alternative Implementations

A number of implementations have been described. Nevertheless, it will be understood that various modifications may be made.

While some of the foregoing examples are described with respect to the roller 300 or the roller 800, it is understood that the roller 300 is similar to the rear roller 104 and that the roller 800 is similar to the forward roller 105. In particular, the V-shaped path for a vane 224*a* of the rear cleaning roller 104 can be symmetric to the V-shaped path for a vane 224*b* of the forward cleaning roller 105, e.g., about a vertical plane equidistant to the longitudinal axes 126*a*, 126*b* of the cleaning rollers 104, 105. The legs for the V-shaped path for the vane 224*b* extend in the counterclockwise direction 130*b* along the outer surface of the shell 222*b* of the forward cleaning roller 105, while the legs for the V-shaped path for the vane 224*a* extend in the clockwise direction 130*a* along the outer surface of the shell 222*a* of the rear cleaning roller 104.

In some implementations, the rear cleaning roller 104 and the forward cleaning roller 105 have different lengths. The forward cleaning roller 105 is, for example, shorter than the rear cleaning roller 104. The length of the forward cleaning roller 105 is, for example, 50% to 90% the length of the rear cleaning roller 104, e.g., 50% to 70%, 60% to 80%, 70% to 90% of the length of the rear cleaning roller 104. If the lengths of the cleaning rollers 104, 105 are different, the cleaning rollers 104, 105 are, in some cases, configured such that the minimum diameter of the shells 222*a*, 222*b* of the cleaning rollers 104, 105 are along the same plane perpendicular to both the longitudinal axes 126*a*, 126*b* of the cleaning rollers 104, 105. As a result, the separation between the shells 222*a*, 222*b* is defined by the shells 222*a*, 222*b* at this plane.

Accordingly, other implementations are within the scope of the claims.

What is claimed is:

1. A cleaning head for a cleaning robot, the cleaning head comprising:

a first cleaning roller comprising a first sheath, the first sheath comprising a first shell and a first plurality of vanes extending along the first shell and extending radially outward from the first shell, the first shell tapering from end portions of the first sheath toward a center of the first cleaning roller, and the first plurality of vanes having a uniform height relative to a first axis of rotation of the first cleaning roller; and a second cleaning roller comprising a second sheath, the second sheath of the second cleaning roller comprising a second shell and a second plurality of vanes extending along the second shell and extending radially outward from the second shell, the second shell being cylindrical along an entire length of the second cleaning roller, and the second plurality of vanes having a uniform height relative to a second axis of rotation of the second cleaning roller.

2. The cleaning head of claim 1, further comprising:

one or more dampeners positioned between the cleaning head and a body of the cleaning robot.

3. The cleaning head of claim 1, further comprising:

a plurality of raking prows on a forward portion of the cleaning head, wherein each raking prow of the plurality comprises a rounded forward portion.

4. The cleaning head of claim 1, wherein the first cleaning roller and the second cleaning roller each extend within 2 cm of a side edge of the cleaning robot.

5. The cleaning head of claim 1, wherein the first cleaning roller comprises collection wells defined by outer end portions of a first core and the first sheath.

6. The cleaning head of claim 1, wherein the second cleaning roller comprises collection wells defined by outer end portions of a second core and the second sheath.

7. The cleaning head of claim 1, wherein the first cleaning roller is located forward of the second cleaning roller in the cleaning head with respect to a direction of motion of the cleaning robot.

8. The cleaning head of claim 1, wherein the first sheath comprises a first plurality of vanes that extend radially outward from the first sheath and wherein the second sheath comprises a second plurality of vanes that extend radially outward from the second sheath.

9. The cleaning head of claim 8, wherein the second sheath further comprises nubs extending radially outward from the second sheath, and wherein the nubs are disposed in rows between one or more of the second plurality of vanes of the second sheath.

10. A cleaning robot comprising:

a robot body;

a drive system configured to move the robot body across a cleaning surface; and a cleaning head configured to remove debris from the cleaning surface, the cleaning head comprising:

a first cleaning roller comprising a first sheath, the first sheath comprising a first shell and a first plurality of vanes extending along the first shell and extending radially outward from the first shell, the first shell tapering from end portions of the first sheath toward a center of the first cleaning roller, and the first plurality of vanes having a uniform height relative to a first axis of rotation of the first cleaning roller; and a second cleaning roller comprising a second sheath, the second sheath of the second cleaning roller comprising a second shell and a second plurality of vanes extending along the second shell and extending radially outward from the second shell, the second shell being cylindrical along an entire length of the second cleaning roller, and the second plurality of vanes having a uniform height relative to a second axis of rotation of the second cleaning roller.

11. The cleaning robot of claim 10, wherein the first sheath comprises a shell, an outer diameter of the shell tapering from a first end portion of the first sheath and a second end portion of the first sheath toward a center of the first cleaning roller.

12. The cleaning robot of claim 10, further comprising:

a second sheath affixed to a second core and extending beyond outer end portions of a second core, wherein the second sheath comprises a first half and a second half each tapering toward the center of a shaft.

13. The cleaning robot of claim 10, further comprising:

one or more dampeners positioned between the cleaning head and the robot body.

14. The cleaning robot of claim 10, further comprising:

a plurality of raking prows on a forward portion of the cleaning head, wherein each raking prow of the plurality comprises a rounded forward portion.

15. The cleaning robot of claim 10, wherein the first cleaning roller and the cleaning second roller each extend within 2 cm of a side edge of the cleaning robot.

16. The cleaning robot of claim 10, wherein the first cleaning roller comprises collection wells defined by outer end portions of a first core and the first sheath.

17. The cleaning robot of claim 10, wherein the second cleaning roller comprises collection wells defined by outer end portions of a second core and a second sheath.

18. The cleaning robot of claim 10, wherein the first cleaning roller is located forward of the second cleaning roller in the cleaning head with respect to a direction of motion of the cleaning robot.

19. The cleaning robot of claim 10, wherein the first sheath comprises a first plurality of vanes that extend radially outward from the first sheath and wherein a second sheath comprises a second plurality of vanes that extend radially outward from the second sheath.

20. The cleaning robot of claim 19, wherein the second sheath further comprises nubs extending radially outward from the second sheath, and wherein the nubs are disposed in rows between one or more of the second plurality of vanes of the second sheath.

* * * * *